US010006154B2

(12) United States Patent
Molnar

(10) Patent No.: US 10,006,154 B2
(45) Date of Patent: Jun. 26, 2018

(54) AGGREGATING TEXTILES FOR PRODUCTION

(71) Applicant: WOVNS LLC, Cambridge, MA (US)

(72) Inventor: Dena P. Molnar, Somerville, MA (US)

(73) Assignee: WOVNS LLC, Berkeley, CA (US)

( * ) Notice: Subject to any disclaimer, the term of this patent is extended or adjusted under 35 U.S.C. 154(b) by 419 days.

(21) Appl. No.: 14/848,213

(22) Filed: Sep. 8, 2015

(65) Prior Publication Data

US 2016/0069003 A1 Mar. 10, 2016

Related U.S. Application Data

(60) Provisional application No. 62/047,135, filed on Sep. 8, 2014.

(51) Int. Cl.
*G06F 19/00* (2018.01)
*D03D 51/00* (2006.01)
*D03C 19/00* (2006.01)

(52) U.S. Cl.
CPC ..... *D03D 51/007* (2013.01); *D03C 19/005* (2013.01)

(58) Field of Classification Search
CPC .... D03C 19/005; D03D 51/007; D03D 51/00; D03J 1/006; D03J 1/10; D03J 2700/04; D03J 2700/06
USPC ..... 700/130, 131, 140
See application file for complete search history.

(56) References Cited

U.S. PATENT DOCUMENTS

| | | | | |
|---|---|---|---|---|
| 6,690,990 | B1 * | 2/2004 | Caron | B27G 1/00 144/363 |
| 8,428,767 | B2 * | 4/2013 | Tremoureux | B26D 5/00 700/134 |
| 2004/0133297 | A1 * | 7/2004 | Vergote | D03D 51/18 700/140 |

* cited by examiner

*Primary Examiner* — Nathan Durham
(74) *Attorney, Agent, or Firm* — Wolf, Greenfield & Sacks, P.C.

(57) ABSTRACT

Techniques for operating a loom to produce multiple different textiles during a single operation of the loom. Conventionally, a loom produces a single textile during each single operation of the loom. When producing multiple different textiles during a single operation of the loom, a single run of the mill may generate the multiple different textiles for multiple different customers. In some embodiments, during a single operation of a loom, the loom may generate a single piece of loom-finished fabric that includes multiple different textiles for multiple different customers and, following the single run of the mill, the single piece of loom-finished fabric may be cut apart to yield the different textiles, which may be one, two, more than five, more than ten, or any suitable number of different textiles for any suitable number of different customers.

26 Claims, 15 Drawing Sheets

Weave number to map to given weft's position in the box motion.

Fill C (Lemon Lime) on fabric face.

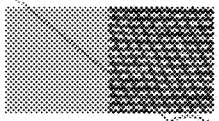

112 / 18- 10
Black & Gold # b8b34b

Weave 18 = Color in Position 3 ( Here , Weft C, 30/ 2 Rayon Lemon Lime) weaves on the fabric face in Rotation ABC).

In rotation CDF however, C moves to position 1 and is mapped to Weave 10, as weave 10 specifies a weft in the first position of the rotation to come to the face.

Fill D (Mud) on fabric face.

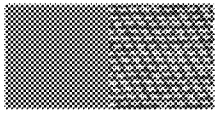

128 / 10- 14
Ochre # 927537

Weave 10 = Color in Position 1 ( Here, Weft D, 30/ 2 Rayon Mud) weaves on the fabric face in Rotation ABC).

In rotation CDF however, D moves to position 2 and is mapped to Weave 14, as weave 14 specifies a weft in the second position of the rotation to come to the face.

Fill F (Dusty Blue) on fabric face.

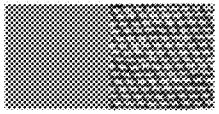

208 / 18
Blue Smoke # 79889b

Weave 18 = Color in Position 3 ( Here, Weft F, 30/ 2 Rayon Dusty Blue) weaves on the fabric face in Rotation ABC).

In rotation CDF, F does not get mapped to a different weave number, as weave 18 specifies a weft in the third position of the rotation to come to the face.

Fill D + F (Mud + Dusty Blue) on fabric face.

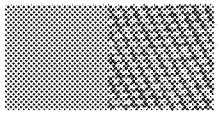

224 / 29- 35
Marble # a7a298

Weave 29 = Colors in Positions 1 and 3 ( Here, Weft D, 30/ 2 Rayon Mud and Weft F, 30/ 2 Rayon Dusty Blue, respectively) weave on the fabric face in Rotation ABC).

In rotation CDF however, D moves to position 2; F remains in position 3 and is mapped to Weave 35, as weave 35 specifies wefts in the second and third position of the rotation come to the face.

FIG. 6D

AGGREGATING TEXTILES FOR PRODUCTION

CROSS-REFERENCE TO RELATED APPLICATIONS

This application claims priority under 35 U.S.C. § 119(e) to U.S. Provisional Application Ser. No. 62/047,135, titled "Aggregating textiles for production," filed on Sep. 8, 2014, which is herein incorporated by reference in its entirety.

FIELD

Embodiments relate to techniques for aggregating textiles, based on quality attributes of the textiles, for weaving in aggregate on a loom during a single operation of the loom.

BACKGROUND

Textiles may be produced by weaving. Weaving includes interlacing materials, such as yarns. A loom may be operated to produce a textile by interlacing materials.

SUMMARY

In one embodiment, there is provided a method of producing an aggregate textile comprising a plurality of different textiles that a plurality of different customers requested be produced. The method comprises operating at least one processor to carry out acts of receiving information describing each textile of the plurality of different textiles to be produced, the information comprising, for each textile of the plurality of different textiles, one or more quality attributes for the textile, evaluating quality attributes for each of the plurality of different textiles to identify two or more textiles of the plurality of different textiles having matching quality attributes, and generating a specification for the aggregate textile based on the information describing the two or more textiles. The specification of the aggregate textile includes at least some of the quality attributes for the two or more textiles and specifying that the aggregate textile is to be woven by weaving the two or more textiles in a series during a single run of a loom.

In another embodiment there is provided an apparatus comprising at least one processor and at least one storage medium having encoded thereon executable instructions that, when executed by the at least one processor, cause the at least one processor to carry out a method of producing an aggregate textile comprising a plurality of different textiles that a plurality of different customers requested be produced. The method comprises receiving information describing each textile of the plurality of different textiles to be produced, the information comprising, for each textile of the plurality of different textiles, one or more quality attributes for the textile, evaluating quality attributes for each of the plurality of different textiles to identify two or more textiles of the plurality of different textiles having matching quality attributes, and generating a specification for the aggregate textile based on the information describing the two or more textiles. The specification of the aggregate textile includes at least some of the quality attributes for the two or more textiles and specifying that the aggregate textile is to be woven by weaving the two or more textiles in a series.

In a further embodiment, there is provided at least one non-transitory computer-readable storage medium having encoded thereon executable instructions that, when executed by at least one processor, cause the at least one processor to carry out a method of producing an aggregate textile comprising a plurality of different textiles that a plurality of different customers requested be produced. The method comprises receiving information describing each textile of the plurality of different textiles to be produced, the information comprising, for each textile of the plurality of different textiles, one or more quality attributes for the textile, evaluating quality attributes for each of the plurality of different textiles to identify two or more textiles of the plurality of different textiles having matching quality attributes, and generating a specification for the aggregate textile based on the information describing the two or more textiles. The specification of the aggregate textile includes at least some of the quality attributes for the two or more textiles and specifying that the aggregate textile is to be woven by weaving the two or more textiles in a series.

In another embodiment, there is provided a method comprising operating at least one processor to carry out acts of receiving, from a plurality of different customers, specifications for a plurality of different textiles, aggregating the specifications for the plurality of textiles to produce a specification of a single aggregated textile, the specification of the single aggregated textile including at least a portion of each of the specifications for the plurality of textiles and specifying that the plurality of textiles are to be woven in a series, and triggering operation of a loom to produce, during a single run of the mill, the single aggregated textile including the plurality of textiles.

In a further embodiment, there is provided an apparatus comprising at least one processor and at least one storage medium having encoded thereon executable instructions that, when executed by the at least one processor, cause the at least one processor to carry out a method. The method comprises receiving, from a plurality of different customers, specifications for a plurality of different textiles, aggregating the specifications for the plurality of textiles to produce a specification of a single aggregated textile, the specification of the single aggregated textile including at least a portion of each of the specifications for the plurality of textiles and specifying that the plurality of textiles are to be woven in a series, and triggering operation of a loom to produce, during a single run of the mill, the single aggregated textile including the plurality of textiles.

In another embodiment, there is provided a method of aggregating textiles to be woven in aggregate during a single operation of a loom, wherein a palette of a plurality of palettes of colors is used in designing each of the textiles, wherein each palette is associated with one of a plurality of different permutations of different textile materials, wherein each color of a palette corresponds to a type of weave in which at least some of the textile materials of the permutation with which the palette is associated are to be woven to produce the textile, and wherein each palette includes colors corresponding to at least some of a plurality of different types of weaves. The method comprises receiving, from a plurality of different customers, specifications for a plurality of different textiles, each specification indicating for a corresponding textile of the plurality of textiles a pattern of the textile to be woven, wherein each specification indicates which palette of the plurality of palettes was used in designing the textile and identifies different regions of the pattern of the textile by indicating a different color from the palette, aggregating specifications for some of the plurality of textiles to produce a specification of a single aggregated textile, wherein aggregating the specifications comprises aggregating specifications for textiles of the plurality of different textiles for which the specifications indicate the same palette was used in designing the textile, and triggering operation of a loom to produce, during a single run of the mill, the single aggregated textile including the plurality of textiles.

In a further embodiment, there is provided an apparatus for aggregating textiles to be woven in aggregate during a single operation of a loom, wherein a palette of a plurality of palettes of colors is used in designing each of the textiles, wherein each palette is associated with one of a plurality of different permutations of different textile materials, wherein each color of a palette corresponds to a type of weave in which at least some of the textile materials of the permutation with which the palette is associated are to be woven to produce the textile, and wherein each palette includes colors corresponding to at least some of a plurality of different types of weaves. The apparatus comprises at least one processor and at least one storage medium having encoded thereon executable instructions that, when executed by at least one processor, cause the at least one processor to carry out a method. The method comprises receiving, from a plurality of different customers, specifications for a plurality of different textiles, each specification indicating for a corresponding textile of the plurality of textiles a pattern of the textile to be woven, wherein each specification indicates which palette of the plurality of palettes was used in designing the textile and identifies different regions of the pattern of the textile by indicating a different color from the palette, aggregating specifications for some of the plurality of textiles to produce a specification of a single aggregated textile, wherein aggregating the specifications comprises aggregating specifications for textiles of the plurality of different textiles for which the specifications indicate the same palette, was used in designing the textile; and triggering operation of a loom to produce, during a single run of the mill, the single aggregated textile including the plurality of textiles.

In another embodiment, there is provided at least one non-transitory computer-readable storage medium having encoded thereon executable instructions that, when executed by at least one processor, cause the at least one processor to carry out a method of producing a palette of a plurality of palettes of colors to be used in designing the textiles, wherein each palette is associated with one of a plurality of different permutations of different textile materials, wherein each color of a palette corresponds to a type of weave in which at least some of the textile materials of the permutation with which the palette is associated are to be woven to produce the textile, and wherein each palette includes colors corresponding to at least some of a plurality of different types of weaves. The method comprises, for a palette associated with a particular combination of textile materials, selecting a subset of textile materials of the particular combination, the subset of textile materials comprising two or more textile materials, and simulating a color that would result from weaving at least some of the particular combination of textile materials such that the textile materials of the subset come to a front of a textile resulting from the weaving, the at least some of the particular combination of textile materials comprising the textile materials of the subset.

The foregoing is a non-limiting summary of the invention, which is defined only by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIGS. 6A-6D illustrate examples of palettes of weave options with which some embodiments may operate;

DETAILED DESCRIPTION

Brief Discussion of Some Embodiments

Figure 1:
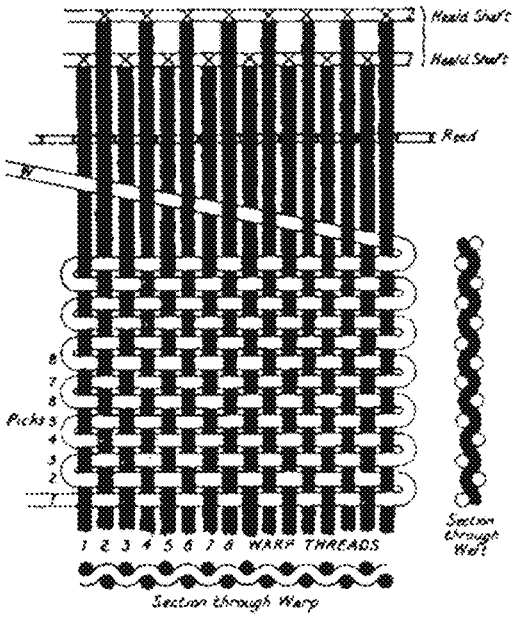
FIG. 1 is an illustration of an example of a woven textile.

The inventors have recognized and appreciated the advantages of operating a loom to produce multiple different textiles during a single operation of the loom. Conventionally, a loom produces a single textile during each single operation of the loom. When producing multiple different textiles during a single operation of the loom, a single run of the mill may generate the multiple different textiles for multiple different customers. In some embodiments, during a single operation of a loom, the loom may generate a single piece of loom-finished fabric that includes multiple different textiles for multiple different customers and, following the single run of the mill, the single piece of loom-finished fabric may be cut apart to yield the different textiles, which may be one, two, more than five, more than ten, or any suitable number of different textiles for any suitable number of different customers.

Beyond recognizing the advantages of operating a loom in such a manner, the inventors have recognized and appreciated that aggregating textiles for production in some particular manners, based on particular attributes of the textiles, may be particularly desirable in some cases. For example, the inventors have recognized and appreciated the advantages of aggregating textiles for production based on attributes of a quality of each of the textiles. In an example of such a process, each of a group of textiles may be evaluated to determine one or more attributes of a quality of the textiles and the textiles may be sorted into one or more groups based on the attributes. Each group of textiles may then be produced together using a loom, such that a single piece of mill-finished fabric may be produced that includes the textiles of each group.

In embodiments in which textiles are aggregated based on one or more attributes of a quality of the textiles, the quality and the attribute(s) of each textile may be identified in any suitable manner. In some embodiments, a computer-implemented facility may be used to determine the quality and the attribute(s) of the textile. For example, a textile aggregation facility (which may be implemented as executable instructions (e.g., software) executing on one or more processors of one or more computing devices) may receive as input multiple units of computer data that each describe one of a multitude of different textiles to be woven using a loom. Each unit of computer data—which may be a computer file or any other suitable computer data structure, and which for ease of description may be referred to below as a computer file—may contain information regarding a repeating unit for a textile and characterizes a quality of a textile to be produced. The computer file may characterize the quality by specifying at least one attribute of a textile to be produced based on the computer file. The textile aggregation facility may review the characterization of quality set forth by each computer file and, based on the review, aggregate the textiles into one, two, or more groups.

A quality of a textile may be characterized by a number of different attributes, and a textile aggregation facility may aggregate textiles based on any one or more of the attributes in any suitable manner. In some embodiments, the textile aggregation facility may identify textiles having attributes that are identical to one another. For example, some quality attributes may relate to the textile materials that are to be used to produce the textiles, such as the colors of yarns to be included in the textiles and the types of fibers included in those yarns. As discussed in more detail below, in a single operation of a loom, during a configuration phase the loom is loaded with yarn having the colors and types of fibers specified for a textile to be produced during the single operation. To produce multiple different textiles during a single operation of the loom, in some embodiments the textile aggregation facility may identify textiles that include identical colors and types of fibers such that the textiles can be produced using the same yarn.

The inventors have recognized and appreciated, however, that textiles may be aggregated for production despite not having identical quality attributes. With respect to color and types of fibers, for example, textiles may be aggregated despite not using identical colors or types of fibers. A loom may be arranged to be loaded with multiple yarns having different colors and types of fibers, such as 6 or 8 different weft yarns, which is referred to as the creel. The inventors have recognized that textiles could be aggregated for production when the textiles include the same or a matching creel, such as by collectively including up to a maximum number of colors and types of yarn. In such a case, each textile may use only some (e.g., three, four, or up to the maximum number) of the colors/types of yarn, but collectively the textiles use no more than the maximum. Thus, these textiles can be produced by a loom without the yarns needing to be changed on the loom between textiles, and thus can be produced by the loom during a single operation of the loom. The textile aggregation facility may therefore aggregate the textiles for production despite the textiles not being identical or not having identical quality attributes.

Examples of quality attributes that the textile aggregation facility may use to aggregate textiles and techniques a textile aggregation facility may use to evaluate attributes for aggregation are discussed in further detail below.

In some embodiments, as discussed above, a textile aggregation facility may evaluate computer files describing textiles following receipt of the computer files to determine how the textiles may be aggregated for production. In other embodiments, however, computer data regarding a textile may indicate how the textile is to be aggregated and may be received by the textile aggregation facility together with the computer file describing the textile. For example, in some embodiments an operator of the textile aggregation facility (e.g., a business providing textile aggregation services) may identify limited sets of options for textiles that can be produced, such as limited sets of permutations of quality attributes for textiles. Each set of quality attributes may be associated with a group for aggregating textiles, such that textiles that have quality attributes that correspond to one of the sets of quality attributes can be grouped together and can be produced together. In some such embodiments, a consumer who is requesting production of a textile and providing a computer file for the textile may be prompted to identify one of the sets of limited options of quality attributes to which that consumer's textile corresponds. Upon receipt of the consumer's selection, computer data identifying the set of options may be communicated to the textile aggregation facility together with the computer file describing the textile and the facility may aggregate textiles based on the consumer's selection.

Accordingly, described herein are various techniques for aggregating textiles for production, including selecting textiles to be produced together based on quality attributes of those textiles. Further details of specific embodiments of such techniques will be appreciated from the discussion below. It should be appreciated, however, that embodiments are not limited to operating in accordance with any of the specific examples below.

Discussion of Weaving and Terminology

A textile is a form of cloth that has been produced through weaving. The term "textile" is occasionally used in the art to refer to materials that may be woven to produce textiles or to goods that involve textiles. As used herein, however, the term "textile" refers to a product of weaving, such as a woven fabric. The materials that may be used in weaving a textile, such as yarns, may be referred to as "textile materials." Goods that include textiles, such as garments and architectural accent pieces, may be referred to below as "woven goods."

In some cases, a textile may be subjected to additional textile processing beyond weaving, including opening, carding, spinning, plying, twisting, texturing, coning, quilling, beaming, slashing, or knitting. Further, in some cases, a textile may be subjected to finish processing (or "finishing"), including bleaching, dyeing, printing, heat-setting, napping, embossing, pressing, calendaring, or application of chemicals to change a character of a textile. It should be appreciated that, as used herein, the term "textile" may apply to a fabric or other material that has been woven and that may or may not be, or may or may not have been, subjected to such additional textile processing and/or finish processing.

To assist with understanding weaving terminology, the terminology will be described in connection with a basic form of weaving a textile in which textile materials are interlaced in a two-dimensional array. In the two-dimensional array, textile materials extending in a first direction (which, for ease of description below, may be referred to as the "vertical" direction) are referred to as "warp" or "end" materials and textile materials extending in a second direction (which, for ease of description below, may be referred to as the "horizontal" direction) are referred to as "weft" or "filling" materials. FIG. 1 illustrates an example of such a two-dimensional array of warps and wefts.

To interlace the materials during weaving, weft materials may be passed over and under the warp materials extending along the length of the warp materials. The weft materials may be passed over and under the warp materials according to multiple factors including a type of the weave. Examples of types of weaves include a plain weave pattern, a satin pattern, and a twill pattern. A plain weave pattern may include alternating passing the weft materials over and under adjacent warp materials in a horizontal direction in the textile. Other types of weaves may define other patterns for passing weft materials over and under warp materials.

The type of a weave, as well as the warp and weft materials that are woven according to the weave type, are among the attributes of a textile that are collectively referred to as a "quality" of the textile. The quality of a textile describes an overall composition of the textile. Quality attributes include characteristics of a structure of a textile, which includes information on a style, width, type of weave, and thread count of the textiles, and/or a quality of textile materials used in the weaving. Thread count may include an end count and a pick count, which respectively refer to a count of warp ends and a count of weft ends. Each of the thread count, end count, and pick count may be measured according to any suitable dimension, such as per inch. A width of a textile may refer either to a width following weaving or a repeat width of a design that is repeated in a pattern in the textile. Quality attributes of textile materials (either warp or weft materials) may include composition, color, or weight of the textile materials. The composition of a textile material may refer to the fibers used in constructing the textile material (e.g., yarn), including how the fibers are combined to form the textile material (e.g., yarn). The weight of a textile material may refer to a size or density of the textile material or the fibers of the textile material, including denier or tex measurement for the textile material. A quality of the textile material may also, in some cases, refer to a manner in which the textile is to be or was produced, such as a manner in which a loom is to be operated to produce the textile. For example, a quality of a textile may refer to a type of operation that a loom may perform in producing the textile, such as a box motion that a loom may use to select weft materials for weaving during production of the textile.

Discussion of Looms and Terminology

Figure 2:
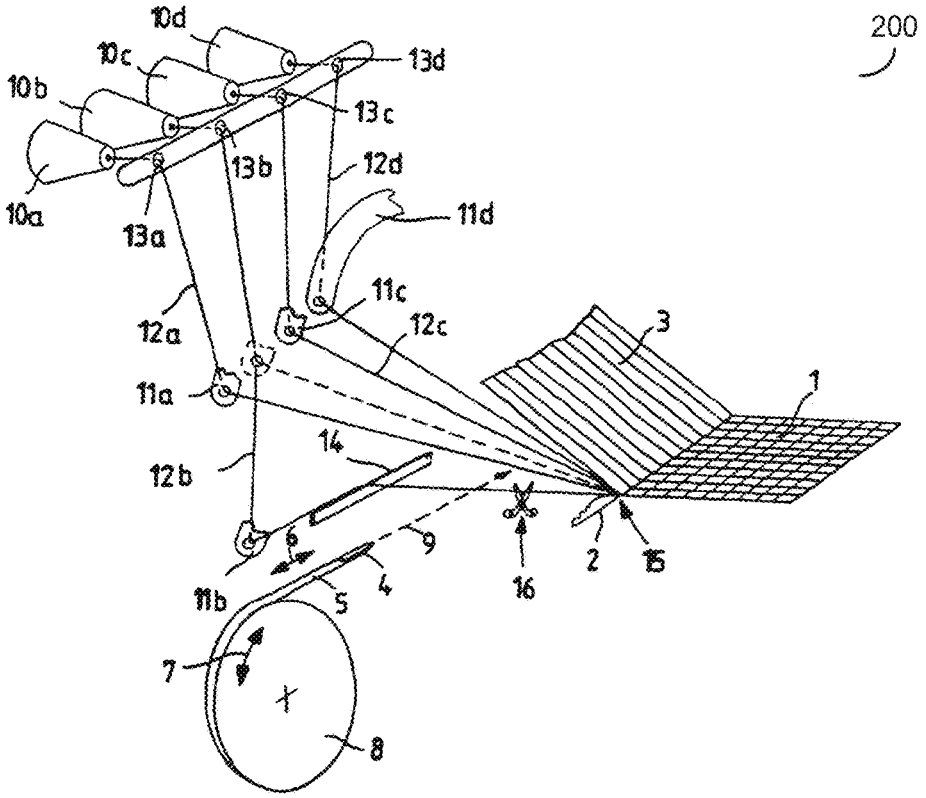
FIG. 2 is an illustration of a part of an example of a loom with which some embodiments may operate.

FIG. 2 illustrates an example of a loom with which some embodiments may operate. It should be appreciated, however, that embodiments are not limited to operating with any particular type of loom. Embodiments may operate with Jacquard looms, Dobby looms, or another type of Power loom. Embodiments are also not limited to operating with looms that include any particular type(s) of machinery, such as looms that use any particular type of weft insertion. For example, embodiments may operate with looms that use shuttle, air jet, water jet, Picanol rapier, or projectile weft insertion.

The right side of FIG. 2 fabric 1 being produced through operation of a loom 200. The loom 200 weaves the fabric 1 in a "shed" of the loom 200. FIG. 2 illustrates the shed formed of warp materials open in two planes 2 and 3. The warp materials are opened, and moved from one of the planes 2,3 to the other, by the movement of heddles. The heddles are not shown in the figures for simplicity. The loom 200 weaves the fabric 1 by, each time the shed opens (e.g., the warp materials are moved between planes 2, 3), inserting one or more weft materials into the shed and between the planes 2,3. The arrangement of the warp materials in the shed, and the weft materials that are inserted, may vary between textiles depending on the textile pattern to be produced.

To insert the weft materials into the shed and weave the fabric, the weft materials are delivered to a gripper 4 that is propelled and guided into the shed by a semirigid tape 5. The tape 5 winds and unwinds in the direction of the double arrow 6 and moves in the direction of trajectory 9. This movement is produced by a rotary movement, in the direction of the arrow 7, of wheels 8. In some looms, the insertion gripper is implemented as a pair of grippers that move from opposite sides of the shed and meet in the middle. The first of the grippers takes the weft materials from the presentation rods 11*a*-11*d* and moves the weft materials from one edge of the shed to the middle of the shed, and transfers the weft materials to the second gripper. The second gripper brings the weft materials back to the other edge of the shed.

Once the weft materials are inserted into the shed, they are compacted together and against the warp materials by beating of the reeds (not shown in FIG. 2 for simplicity) to tighten the weave of the fabric 1.

The weft materials that are to be inserted and woven with the warp materials to form the fabric 1 are contained on bobbins 10. FIG. 2 shows four bobbins 19*a-d* for simplicity of drawing, but it should be appreciated that there may be any suitable number of bobbins, and any suitable number of weft materials, in a loom 200. Looms commonly have eight bobbins.

The weft yarn is presented to the gripper 4 by presentation rods 11*a-d* that receive the weft materials 12*a-d* from a respective bobbin 10*a-d*, after passage through yarn feeders 13*a-d*. The presentation rods 11 are each provided with an end eyelet through which the weft materials 12 pass. These rods can move between two positions, an upper rest position and a lower position in which they deliver the respective weft material to the gripper 4. In FIG. 2, the rods 11*a, c, d* are in their upper position. When in the upper positions, the rods keep the respective weft material out of range of the gripper 4 and keep the material from being inserted into the shed. Rod 11*b* is in its lower position, in which the rod delivers the material 12*b* to the gripper 4 to include the weft material 12*b* in the fabric 1. The rods 11 (for example the rod 11*b* in FIG. 2), when moved into their lowered delivery position, rest their weft material on a stop bar 14 so that the various weft materials individually presented to the gripper 4 lie in a generally horizontal plane defined by an upper edge of the bar 14 and the vertex 15 of the shed, ensuring that all weft materials lie in the same plane.

The operation of the loom 200, including the movements of the heddles and rods to weave weft and warp materials together, is controlled by a loom controller (not shown in FIG. 2). The loom controller operates the loom according to a draft file, which is an image file that defines the textile and the weave. The draft file may have an image resolution that corresponds to the number of warp materials and weft materials in the fabric 1, such that each individual column and row of the draft file corresponds to one warp or one weft material in the fabric 1. In some cases, the draft file may define a repeating unit of the weave and the loom controller may duplicate the weave identified by the draft file multiple times in one or two dimensions to create the fabric 1. In such cases, the draft file may have a size that evenly divides into the size of the fabric 1. For example, a common loom width is 54 inches and a common size of the draft file is 13.5 inches, which allows the loom controller to duplicate the draft file four times across a width of the fabric 1. Other sizes of looms or draft files may be used.

The draft file may define a weave pattern of a fabric using a bitmap representation of two colors. The two colors may illustrate whether, at a particular intersection of a warp material and a weft material in the pattern, the warp or the weft should be on top. Based on the instruction for that location in the draft file, the loom will control the position of the warp material in the shed by operating the heddles to place that warp in the top plane 2 or the bottom plane 3.

The draft file may define other attributes of the textile. For example, the draft file may define a thread count of the textile, such as an end count (a number of warp materials) or a pick count (a number of weft materials). The draft file may also identify types of warp materials or weft materials to be used, such as colors of the materials. A draft file may also, in some cases, identify a way in which control hooks of a loom are to be operated, such as a way in which weft selectors or a regulator are to be operated during weaving. Other loom settings may be specified by some draft files, such as a fringe setting that may be used for inhibiting a broken weft detector, a weft/pick density with which a textile is to be woven, a loom speed at which fabric is to move through the loom, or other settings.

Traditional Business Operations of Mills

During a single operation of the loom, before any textiles are woven the loom is configured to weave using particular warp and weft materials. A typical upholstery loom is 57 inches wide and has 190 warp materials per inch, yielding 10,830 warp ends across the width of the fabric. Each of these 10,830 warp materials must be loaded onto the loom, which is approximately 5 million yards and approximately 200 pounds of yarn. Before the loom can be operated, weft materials must also be loaded onto the loom. Adding weft materials to the loom increases the complexity of the task.

Loading warp and weft materials can take up to 8 hours even using modern looms that have automated loading tools. While the loom is being loaded with materials, the loom is not producing fabric and the mill is thus not making money. As a result, for its business to be economically feasible, the mill must reduce an amount of time that the loom is not being operated and reduce the number of times that the warp materials are changed in any period to increase the proportion of time that the loom is producing fabric. A mill commonly will require that the loom operate for at least 24 hours following being loaded with a warp material. At common loom operation speeds, in 24 hours the loom may produce approximately 480 yards of fabric.

For industrial textile production to be economically feasible, therefore, a mill requires that each customer order a minimum of many dozens or even hundreds of yards of textiles. This has made impossible or at least uneconomical the production of small amounts of textiles for an individual or a small business, or a small sample run of a textile for even a large business. Customers have for decades sought the ability to produce small runs of textiles, but due to their own economic constraints surrounding the time needed to configure a loom before a single run of the loom, mills have been unable and unwilling to accommodate small orders.

This same overhead has limited internal operations of mills, such as the production of sample textiles by a mill for its release to potential customers as marketing or development material, or for its own internal research and development on ways in which a mill might be operated to produce specialty textiles or to be run more effectively, or for other reasons. Sample textiles for marketing, development or R&D are typically produced at small volumes, and the operational cost discussed above has prevented mills from producing these samples as freely as may be best for business operations.

Detailed Description of Some Embodiments

As should be appreciated from the foregoing, the technological and economic constraints on mills have for decades prevented mills from accepting orders for small amounts of textiles. The inventors have recognized and appreciated, however, that if similar textiles were aggregated for production and produced during a single operation of the loom (without the loom needing to be taken offline to load new materials between producing different textiles), small orders of the multiple different textiles could be accommodated while still meeting the minimum orders that the mills need to feasibly operate their business.

Described below are examples of processes that may be used, including by a textile aggregation facility, in various embodiments to aggregate textiles for production during a single operation of a loom. As discussed above, during a single operation of the loom using techniques described herein, a single run of the mill may produce multiple different textiles for multiple different customers, and a single piece of loom-finished fabric may be produced that includes multiple different textiles for multiple different customers.

It should be appreciated that while examples of functionality of a textile aggregation facility are described below as being implemented by one facility, embodiments are not so limited. In some embodiments, the functionality described below may be divided into multiple facilities. Further, in some embodiments in which one facility is used, that facility may be implemented with executable instructions arranged in any suitable format, which may be include being divided between multiple discrete computer program files, as embodiments are not limited in this respect. As a specific example, functionality that is described below as being carried out by a textile aggregation facility may, in some embodiments, be divided between executable instructions executing on one or more computing devices separate from a loom and executable instructions executing on a loom controller of a loom. Thus, in some embodiments, some of the examples of functionality described below may be incorporated into a loom.

Figure 3:
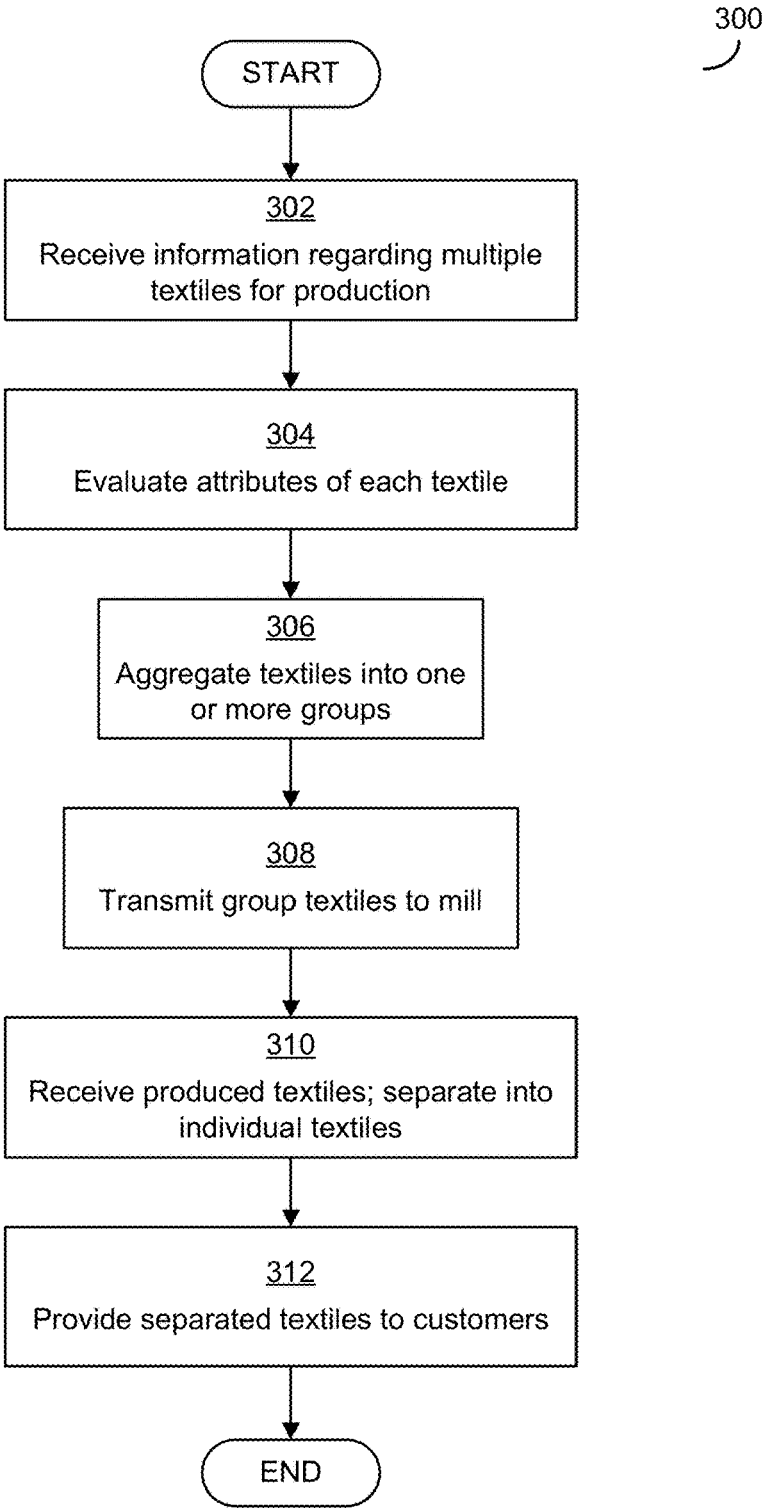
FIG. 3 is a flowchart of an exemplary process that may be implemented in some embodiments to aggregate textiles for production.

FIG. 3 illustrates an example of a process 300 that may be implemented in some embodiments for aggregating textiles for production. The process 300 begins in block 302, in which information regarding multiple different textiles is received. The information may be received in any suitable manner or format, as embodiments are not limited in this respect. The information regarding each textile may include information on a quality of the textile and an amount of the textile to be produced (e.g., a yardage). Information on the quality of the textile may include any suitable set of quality attributes discussed above. The attributes may include information on the warp and/or weft materials that are to be used in producing the textile, such as colors or compositions of the warp/weft materials. The attributes may also include information on the textile, such as a weave pattern or a thread count of the textile.

In block 304, attributes of each textile are evaluated. The evaluation of block 304 may be carried out to determine the textiles that may be woven together during a single operation of a loom. As should be appreciated from the foregoing, textiles may be produced together during a single operation of the loom when, at least, the textiles may be produced using the same warp and weft materials, such that the loom does not need to be stopped and the warp and weft materials do not need to be changed. Accordingly, the evaluation of block 304 may be carried out to determine the color and composition of the warp and weft materials to be used in producing each textile, to determine textiles that use matching colors and compositions. Those of skill in the art will appreciate that a range of colors may be produced using a single combination of warp and weft by changing the arrangement or density of warp/weft materials. For example, with a white warp and a red weft, a range of reds and pinks may be produced by placing more or less of the white warp on top or more or less of the red weft on top. Thus, in evaluating colors in block 304, the textiles may be evaluated to determine whether colors can be produced using the same warp and weft materials, but not necessarily whether the colors of the textiles to be produced are identical. Textiles may also be evaluated to determine whether the textiles have matching thread counts, such as matching pick counts, pick densities, end counts, or end densities. As another example, the textiles may be evaluated to determine whether a loom would produce the textiles using a similar "box motion," which is an order in which weft materials are gathered from rods for insertion. While a loom may often change box motions without affecting the loom or production of textiles, those skilled in the art will appreciate that frequently and drastically changing a box motion during a single operation of a loom could damage the loom. As such, textiles may be evaluated to determine whether they would be produced using similar box motions, or otherwise will be produced using compatible configurations of a loom such that there is no risk of damage to a loom. As those skilled in the art will appreciate, there can never be 0 risk of damage to a loom. Those skilled in the art will therefore understand a reference herein to "no" risk of damage or "without" risk of damage to mean tolerable risk of damage. As another example, a weave pattern of each textile may be evaluated. A width or resolution of a file that defines the textile may also be evaluated in some embodiments. It should be appreciated that any suitable attribute of a textile may be evaluated in block 304, as embodiments are not limited in this respect.

In block 306, based on the evaluating of block 304, textiles with the same or similar attributes may be aggregated for production, such that one or more groups of textiles may be identified for being produced together in a single operation of a loom. As should be appreciated from the foregoing, the aggregation of block 306 is performed to identify textiles that can be produced during a single operation of a loom without the warp and weft materials needing to be changed, or operation of the loom stopped for any other reason. Accordingly, in block 306, textiles that are the "same or similar" may be those textiles that can be produced without operation of a loom being ceased. In some embodiments, a set of attributes that are the same or similar, or a range of attributes that are the same or similar, may be predefined. In such embodiments, textiles may be identified as the same or similar when the attributes fall within the predefined sets or ranges.

In block 308, information on the aggregated textiles for each group is transmitted to a mill for production of the textiles on a loom during a single operation of the loom. The information may be transmitted in any suitable form, as embodiments are not limited in this respect. In some embodiments, digital information about each textile or for the group of textiles may be produced and transmitted to the mill. For example, a draft file for an aggregated set of textiles, or for each textile of an aggregated set, may be generated and sent to the mill. The draft file may be produced in any suitable manner, including using known Computer-Assisted Design (CAD) software for textiles, such as software available from EAT GmbH of Germany.

Once the information on the textiles is transmitted to the mill, the mill produces the textiles during a single operation of the loom and may produce a single piece of mill-finished fabric that includes each of the textiles. In block 310, the produced textiles are received and are separated into the individual textiles received in block 302 and aggregated in block 306. In block 312, once separated, the individual textiles are provided to the customers that ordered each textile and the process 300 ends.

As mentioned above, the information on each textile may be received and evaluated in any suitable manner. In some embodiments, a textile aggregation facility, implemented as executable instructions (e.g., software) executing on one or more computing devices, may receive the information regarding each textile electronically as digital information. The digital information, which may be embodied as a computer file or in any other manner, may define one or more attributes of each textile. The textile aggregation facility may evaluate the digital information to determine the attributes of each textile and aggregate files based on the evaluation.

Figure 4:
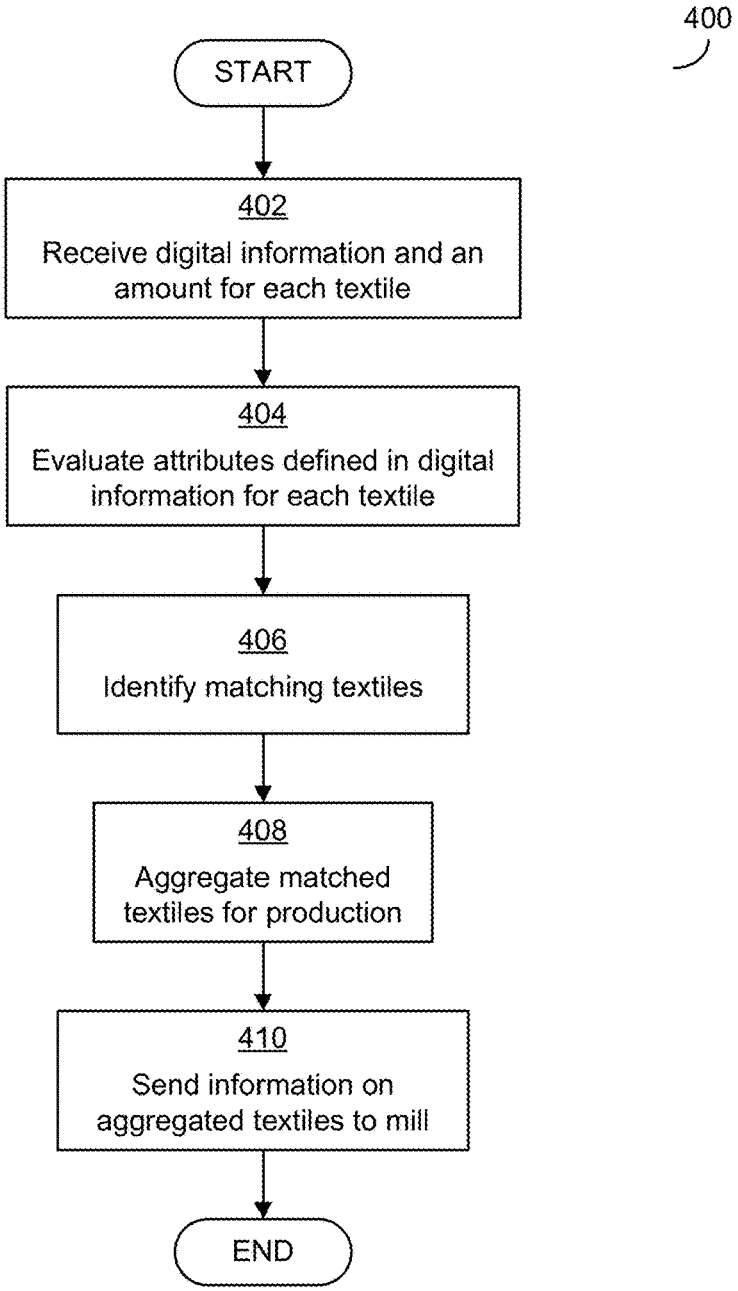
FIG. 4 is a flowchart of an exemplary process that a textile aggregation facility may implement in some embodiments to aggregate textiles for production.

FIG. 4 illustrates a process 400 that may be implemented by a textile aggregation facility in some embodiments. The process 400 begins in block 402, in which the textile aggregation facility receives for each textile digital information (e.g., a file) describing the textile and an amount of that textile to be produced. The digital information may be received in any suitable manner. In some embodiments, a web interface may be presented to customers of an operator of the textile aggregation facility and the customers may operate the web interface to input information regarding the files. Input may be provided via the web interface in any suitable manner, including by selecting options from one or more web pages of the interface or uploading a file via the interface.

In block 404, after the facility receives the information regarding each textile, the facility evaluates attributes for each textile set out in the digital information for the textiles. Based on the evaluation, in block 406 the facility identifies textiles having matching attributes. The facility may perform the evaluation in block 404 and the determination of matching textiles in block 406 in any suitable manner, as embodiments are not limited in this respect. The facility may carry out any of the examples of evaluations discussed above, including the evaluations described in connection with block 304 of FIG. 3. For example, the facility may evaluate attributes of a quality of each textile, including attributes of a quality of warp and/or weft materials to be used, relative to a set of predefined matching attributes or ranges of attributes. In such a case, when the facility determines that two textiles have attributes that fall within the set of matching attributes or ranges of attributes that match, the facility may determine that the textiles match and can be aggregated for production during a single operation of the loom.

In block 408, the textile aggregation facility aggregates the textiles that it determined to be matches. The facility may perform the aggregation in any suitable manner, including according to any of the examples discussed above and the examples described in more detail below. In some embodiments, the facility may use known CAD techniques to produce a draft file for each textile. In other embodiments, the facility may generate a single image file for all the textiles together and then may use known CAD techniques to produce a draft file for the combined textiles. In embodiments in which such known CAD techniques are used, the CAD techniques may be implemented by the textile aggregation facility itself or by an external facility with which the facility communicates, as embodiments are not limited in this respect. Additionally or alternatively, in some embodiments, during the aggregation of block 408, the textile aggregation facility creates a weave program that may be executed by a loom controller of the loom that is to be used to produce the aggregated textiles. The weave program, which may be in any suitable format and that may be in a format dependent on a brand or type of loom to be used, may define a set of instructions to be followed by the loom controller in producing the textiles together during a single operation of the loom.

In block 410, the textile aggregation facility sends information on the aggregated textiles to the mill. The facility may send the information in any suitable manner, as embodiments are not limited in this respect. For example, in some embodiments the facility may send the information via one or more computer networks, such as via the Internet. In other embodiments, the facility may store the information regarding the aggregated textiles in a portable storage medium, such as a compact disc or solid-state memory, and instruct a user to transport or mail the portable storage medium to the mill. In some embodiments, the facility may send the information to the mill in response to determining that a total yardage of the aggregated textiles meets or exceeds a minimum yardage set by a mill that is to produce the textiles. The facility may store information on textiles and continue aggregating textiles until a minimum aggregated yardage is met, then may transmit the information for the textiles to the mill. In some embodiments, the aggregation of block 408 and the sending of block 410 may both be performed in response to determining that a total yardage exceeds the minimum.

Once the information regarding the aggregated textiles is sent in block 410, the process 400 ends.

It should be appreciated from the foregoing that embodiments are not limited to performing the aggregation of textiles in any particular manner. In some embodiments, customers may be permitted to specify attributes of textiles without limitation and a textile aggregation may evaluate the attributes to determine whether textiles can be aggregated and, if so, how to aggregate the textiles. In other embodiments, however, customers may be constrained in the attributes or combinations of attributes they use in their textiles. For example, in some embodiments, an operator of a textile aggregation facility may determine only limited attributes that may be used, such as a particular thread count that all textiles must use to be aggregated or a particular composition of warp or weft materials that all textiles must use. As another example, in some embodiments an operator of a textile aggregation facility may provide greater freedom of attributes to customers, but may constrain customers to using attributes that conform to one of several predefined sets or ranges of attributes. In embodiments that constrain available attributes in these manners, a textile aggregation facility may aggregate textiles based on the predefined attributes.

Figure 5:
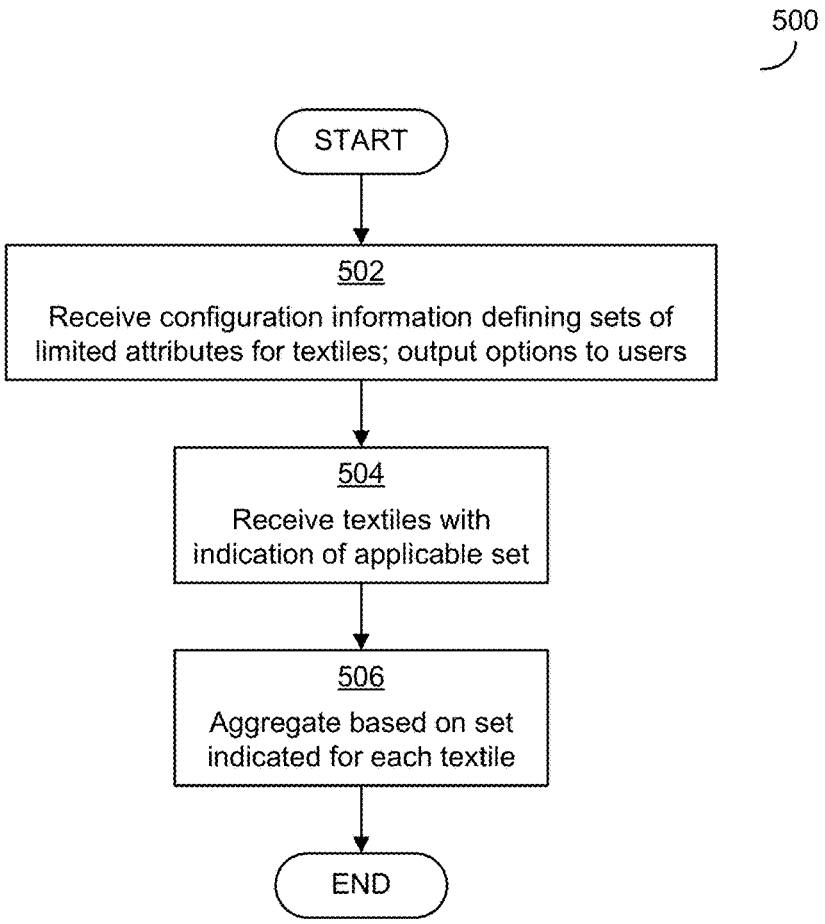
FIG. 5 is a flowchart of an exemplary process that a textile aggregation facility may implement to aggregate textiles for production based on predefined sets of attributes.

FIG. 5 illustrates an example of a process 500 that a textile aggregation facility may implement in some embodiments to aggregate files based on predefined sets of limited attributes. The process 500 begins in block 502, in which a textile aggregation facility receives configuration information defining sets of limited attributes. The sets of limited attributes may be any suitable set, as embodiments are not limited in this respect. In some embodiments, each set may be associated with a different color palette for the textile and each set may be easily identifiable by customers or to customers using the associated color palette. In some such embodiments, the color palette may be defined as the colors that may be produced by a combination of one or more warp materials and one or more weft materials, such as the colors that may be produced by one or two colors of warp in a fixed pattern and six or eight weft materials that are available to be interlaced with that fixed pattern of warp colors. In addition to color palette, each set may be associated with other attributes regarding textiles that may be produced, such as attributes relating to a composition or density of warp/weft materials, thread count (e.g., end count and/or pick count), weave pattern, width of repeat pattern, or any other suitable attribute of a textile. Once the configuration information is received, the textile aggregation facility may output information on the sets for being viewed by users, such that users are able to design their textiles to meet the constraints for one of the sets. The information may be output in any suitable manner, including via a web interface.

In block 504, the textile aggregation facility receives information on textiles. The information may be received in any suitable manner and format, including according to examples described above. The information on each textile may indicate a set of attributes that are applicable to that textile. In some cases, for example, the information may explicitly identify the applicable set of attributes, such as by including an identifier (numeric or otherwise) for the applicable set of attributes. In other embodiments, the information on a textile may implicitly identify the applicable set of attributes. For example, as discussed above, in some embodiments in which each set of attributes is associated with a color palette and the information on a textile may implicitly identify a set of attributes by indicating the colors to be included in the textile. The facility may review the colors for the textile identified by the information for the textile and determine the color palette to which the colors correspond. The facility may determine the color palette in any suitable manner, including by determining a "weave blanket" for each set of attributes using known techniques (e.g., techniques implemented in software available from Aranhe, d.o.o) and then using these known techniques to determine, for a textile, the weave blanket to which the textile corresponds. The facility may then determine that the textile corresponds to the set of attributes to which that color palette relates.

In block 506, the textile aggregation facility may aggregate for production the textiles that use the same set of attributes. The aggregation may be performed in any suitable manner, including according to examples described above. Once the textiles are aggregated by the facility, the process 500 ends.

The example of FIG. 5 described predefined sets of attributes and included examples of attributes that may be included in predefined sets or that may form the basis of predefined sets. FIGS. 6A-6F below describe examples of a particular system that embodiments may implement to aggregate textiles based on predefined sets of attributes. It should be appreciated that the examples of FIGS. 6A-6F are merely illustrative and that other systems are possible.

As described above, in some embodiments, designers of textiles may be constrained to particular types of weaves that may be used, and particular combinations of textile materials that may be woven in those types of weaves. In some such embodiments, these constraints may be organized for designers' ease of use and management into particular "color palettes."

In some embodiments, each color palette may be associated with a different set of textile materials to be loaded onto a creel of a loom. In other embodiments, many different color palettes may be associated with the same weft materials loaded onto a creel, but may be associated with different subsets of those weft materials. For example, where a creel includes 6 or 8 different weft materials, each palette may be associated with "tri-picks" of those wefts to form tri-pick textiles, meaning that each is associated with different sets of three weft materials from those 6 or 8 weft materials. In addition, in some embodiments where multiple different palettes are associated with the same creel of weft materials, each color palette may be associated with a different box motion, which may be a different permutation of those weft materials in the creel. For example, one box motion (and one permutation) for a palette may be a selection of weft materials 1, 2, and 3, in that order, while another box motion for another palette may be a selection of weft materials 3, 2, and 1, in that order. The weft materials that are selected are the same, but due to the difference in the box order, and the resulting difference in how the weft materials are woven by the loom, different techniques may be used for handling the weaving of the weft materials. Such techniques may arise in weaving instructions that instruct a loom how to weave a particular textile. Example of such techniques are described below in connection with FIGS. 6A-6F.

In some embodiments, each color palette may include multiple different colors, with each color representing a particular set of quality attributes for textiles, such as a particular combination of textile materials and type of weave in which to arrange the particular combination of textile materials in the textile. The type of the weave of a color of a palette may be associated with attributes of a weave, such as a weave pattern. The type of weave may impact an appearance of the combination of textile materials in the textile, such as the color of the textile through affecting which weft and/or warp materials are brought to the front of the textile through the type of weave and which weft and/or warp materials are woven. The color that is assigned to each particular combination of textile materials and type of weave in a color palette may correspond to a color that will be produced through weaving those particular textile materials in that particular type of weave. The color may be a true color obtained through weaving the particular combination of textile materials in the type of weave and photographing a resulting color. Alternatively, the color may be a simulated color, obtained by estimating a color that will result from weaving the textile materials according to the type of weave. In other cases, though, the color that is assigned may be unrelated and merely an identifier for the combination of textile materials and type of weave. In addition to a color, each combination of textile materials and type of weave may be associated with an identifier, such as a numeric identifier or "index number," that identifies it within a palette.

Each color palette may be associated with a particular subset of textile materials, which may be a particular warp material and a number of different weft materials. The number of the weft materials may correspond to a number of bobbins on a loom on which an aggregated textile material is to be woven, or may be a subset of those bobbins, such as in the case that all or multiple palettes are associated with the same weft materials in a creel. As should be appreciated from the foregoing, the warp and weft materials are loaded before a loom is operated and control which textiles can be woven during a single operation of the loom without replacing the warp and weft materials, as only textiles produced from those warp and weft materials may be woven without changing the materials. The color palette may be associated with the particular set of warp and weft materials and, more particularly, may be associated with a particular permutation of the weft materials relative to the bobbins of the mill, namely, a specific ordering of the weft materials on the bobbins and/or a particular box motion a loom will use to select some or all of those weft materials from the weft selectors during operation of the loom. As each color palette is associated with a particular permutation of the weft materials, different color palettes may be associated with the same warp and weft materials in a creel, but may differ in which will be used in weaving, and may further differ in box motion used to select the weft materials for weaving.

Each color within the color palette may be associated with a particular type of weave with which the weft materials of the palette are to be woven with the warp materials. The type of weave may regulate which one, two, or more of the weft materials are to be woven such that they appear on a face of the textile rather than a back of the textile, including by regulating the pattern in which the weft materials are woven through the warp materials. A type of weave may be independent of weft materials, and instead be related to positions within a box motion, such as by identifying that the material in the first position of a box motion will come to the face of the textile. The type of weave may therefore be used with different palettes, each of which may include different weft materials as the first material in the box motion and thus result in different textiles when that type of weave is used.

Each color within a color palette may be associated with a particular resulting textile, which may indicate that one, two, or more of the weft materials for the color palette are to appear on a face of the textile in a particular weave pattern. The color palette identifies a box motion in which those one, two, or more weft materials are selected, as mentioned above. By identifying a color palette and a color within that color palette, an identification is made of one or more particular weft materials that is/are to be woven to appear on a face of a textile and a particular position of the weft material(s) within a box motion for the palette. A textile aggregation facility may map this information to a type of weave, which identifies a weave pattern based on positions within a box motion and may be independent of individual weft materials. Using that type of weave with that palette/box motion may result in weft materials, which are selected according to the box motion, being woven in a particular manner to produce a particular textile. Various examples of techniques for performing that mapping are described below in connection with FIGS. 6A-6F.

While examples have been given above and below of using palettes to identify different colors to be produced for different regions of a textile, it should be appreciated from the foregoing that color is only one of the quality attributes of a textile that may characterize a particular region of a textile. Each "color" of a palette may also be associated with other quality attributes of a textile or of textile materials, such as composition of a textile material.

Color palettes, as they are associated with a particular set of warp and weft materials and box motion, may be used in some embodiments as a basis for aggregation of different textiles. Specifically, as the warp and weft materials regulate which textiles may be woven during a single operation of the loom, and a color palette is associated with a specific ordering and selection of weft materials on a loom, different textiles that were designed using the same color palettes would be woven using the same materials and could be produced during the same single operation of the loom. In these embodiments, therefore, different textiles designed using the same color palettes may be aggregated to be woven together.

Figure 6A:
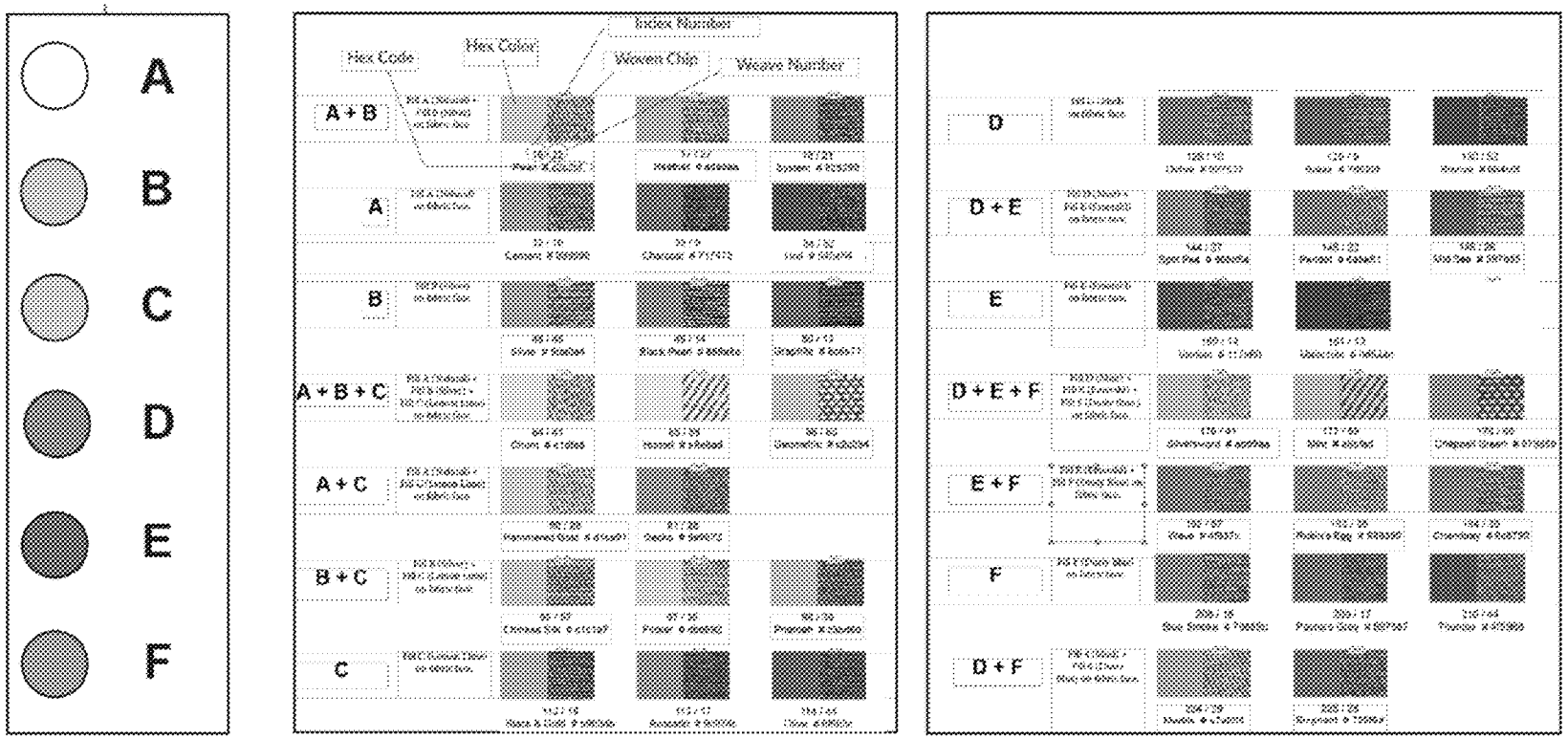

FIG. 6A illustrates two examples of color palettes, each associated with the same creel of six weft materials. In the example of FIG. 6A, the six weft materials are respectively labeled A-F, as shown in the leftmost box of the figure. The middle box shows one palette, including types of weaves that may be woven using a "tri-pick" combination of materials A, B, and C, while the rightmost box shows a second palette including types of weaves that may be woven using a different "tri-pick" combination of materials D, E, and F.

Within each palette, each "color" is associated with three numbers: a "hex code" that is a hexadecimal number for the color assigned to that palette and that type of weave, an index number identifying the color/type of weave within the palette, and a weave number identifying a type of weave that is to be used to weave the weft materials that have been selected by the box motion of that palette. As illustrated in the two example palettes of FIG. 6A, a type of weave may be repeated between palettes and between weft materials, as a type of weave may indicate which weft materials of a set of weft materials will come to a front of a textile. Accordingly, a type of weave that may be woven using weft materials "A+B" may be identified as type of weave number "22," while another weave that may be woven using weft materials "D+E" may also be identified as type of weave number "22." The type of weave may be the same for the two "colors," as the type of weave merely identifies a particular manner of weaving the materials that are located in specific positions of a box motion, whatever those materials may be.

The palettes of FIG. 6A illustrate the different combinations of colors that may be achieved through different combinations of weft materials and types of weaves. For example, the first palette (of the middle box of FIG. 6A) illustrates three examples of textiles that may be woven with two different weft materials coming to the face of the textile, by adjusting the type of weave and, thereby, adjusting which materials come to the face of the textile.

Figure 6B:
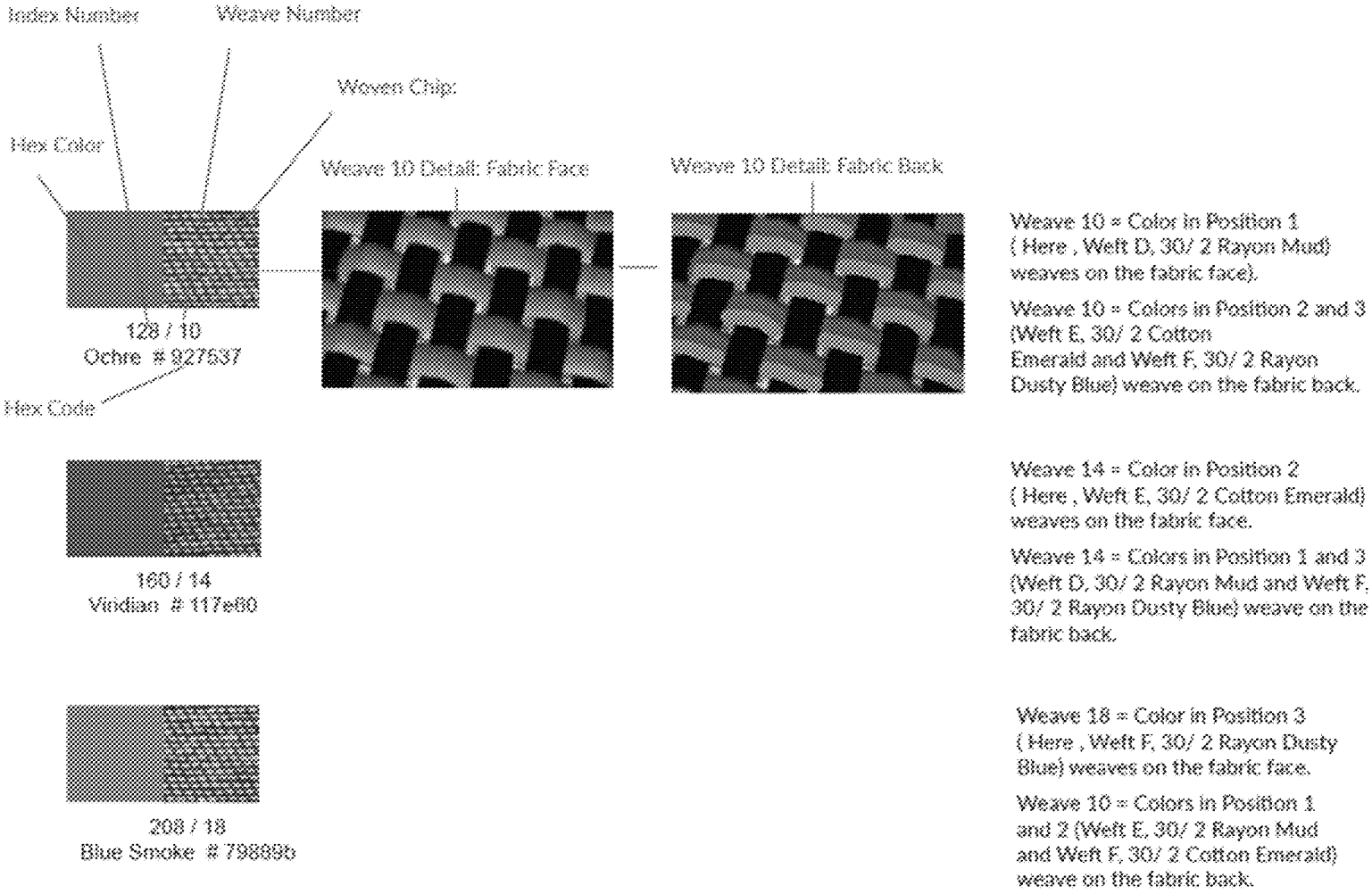

FIG. 6B illustrates additional detail regarding a palette and some example "colors" from that palette. For example, the first "color" shown on the left-hand side of FIG. 6B is labeled "ochre" and includes a hex code "927537" identifying the color to be used to display that color in a design software. The color itself is shown as the "hex color." The color is also associated with a "woven chip" that illustrates the resulting textile, as well as an "index number" identifying this color within the palette and a weave number that is an identifier for a type of weave to be used by a loom to weave the weft materials that are selected by the box motion associated with this palette and to produce the textile identified by this "color" of the palette. FIG. 6B also illustrates additional detail on the type of weave, showing a representation of the front and back of a textile that results from weaving the weft materials of this palette according to the type of weave identified by weave number "10." On the right-hand side of FIG. 6B, additional details regarding how the weft materials of the palette are to be woven according to weave number "10" is also provided. As explained by this additional detail, in weave number "10," only one weft material comes to the face of the textile resulting from the weaving, which is the weft material that is collected first in a box motion. In the example palette of FIG. 6B, which is the second palette from FIG. 6A, the weft material D is collected first in the box motion. If a different box motion were used and the weft material were collected in a different position of the box motion, the type of weave would be different. Similar information is provided for the two other example "colors" of FIG. 6B, which are respectively associated with a type of weave identified by weave number "14" and a type of weave identified by weave number "18."

Figure 6C:
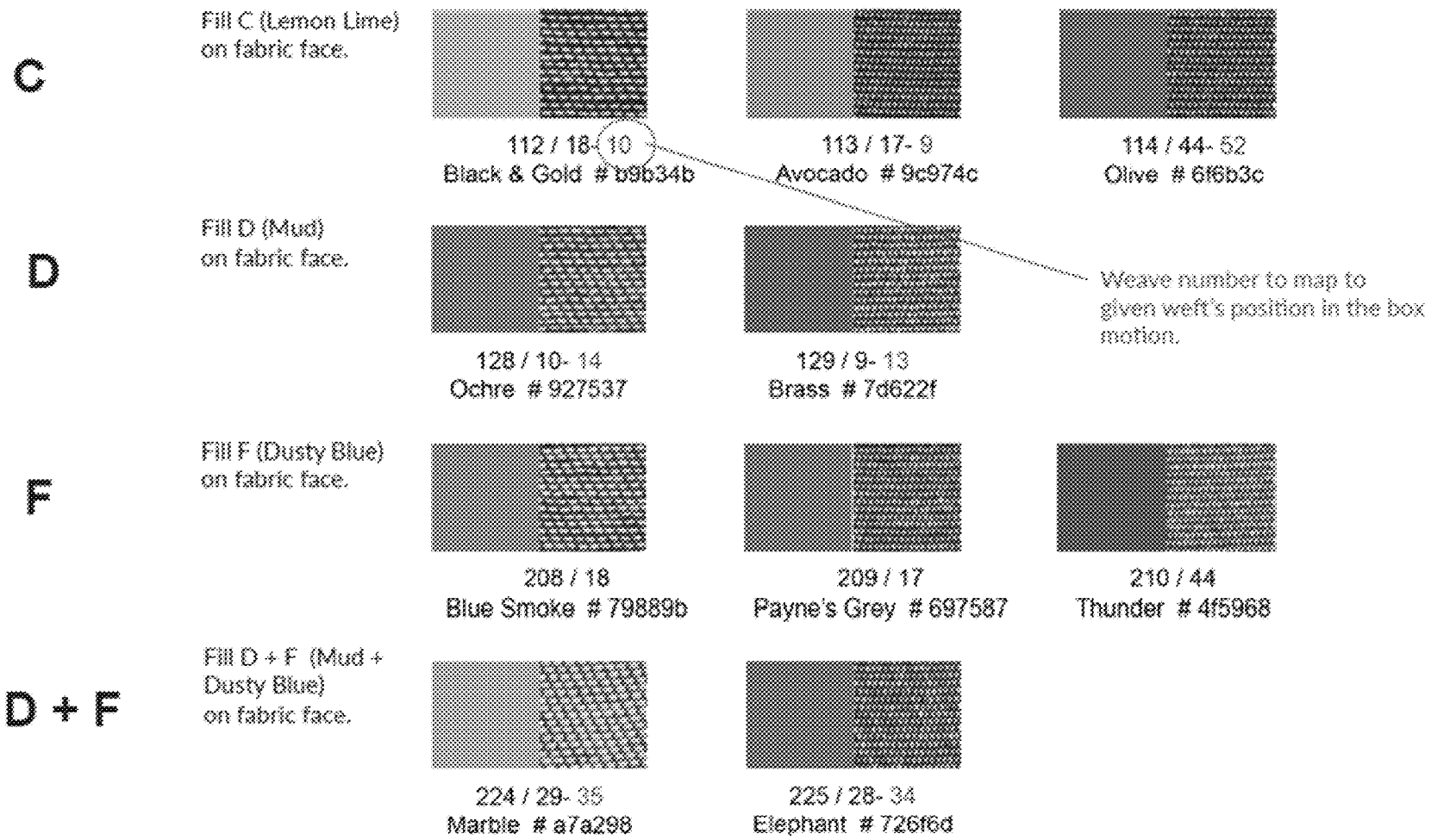

FIGS. 6C-6D illustrate examples of mapping an index number or color for a textile (or a region of a textile), and a palette used to design the textile that identifies the box motion for ordering and selecting some of the weft materials of a creel, to a type of weave to be used by a loom in weaving textile materials to produce the textile (or region). As discussed above, a type of weave may include various attributes of a weave, including a weave pattern. As mentioned above, two different palettes may include some of the same weft materials and, thus, some of the same textiles may be produced with the same palettes (i.e., the textiles that are to be woven using the same textile materials). However, as mentioned above, for different palettes, the weft materials may be loaded at different positions in a box motion. Accordingly, while the one, two, or more weft materials that are to be woven may be the same between two palettes, different types of weaves may be used to weave them because the box motion to be used by the loom to gather the weft materials may differ, leading to differences in placement of the materials within the box motion.

FIG. 6C illustrates examples of "colors" of a palette that may be produced using a second, different palette due to overlap of the textile materials for those palettes, but for which the positions of the weft materials in the box motions differ, leading to different types of weaves being used for the two palettes to produce the same textile. For example, as shown in the leftmost "color" of the first line of FIG. 6C, a color identified with index 112 for one palette and that is woven using the type of weave identified as weave number "18" for that palette, may be woven using the type of weave identified as weave number "10" for another palette, due to differences in the positions of the weft materials in the box motions used to collect those weft materials. FIG. 6D provides more detail on the mapping between weave number "18" and weave number "10" due to these differences, as well as additional mappings between types of weaves.

Accordingly, in some embodiments, a textile aggregation facility may aggregate textiles based on a palette used to design the textiles. In some such embodiments, when a textile is to be woven, the "color" identified for a region of the textile and the palette (which identifies a particular box motion for the palette) may be mapped to a particular type of weave to be used for weaving weft materials of the palette through the warp materials of the palette. The facility may identify the type of weave based on the index number for the palette and the palette itself. The index number for the palette may identify weft materials to be woven and which weft materials are to be brought to the face of the textile and in what pattern, and the palette may identify a permutation of weft materials that identifies positions of the weft materials in a box motion that is used to select the materials from a creel. Based on which weft materials are to be woven and in what pattern, as identified by the index number, and based on the arrangement of the weft materials in the box motion, as identified by the palette, the facility will identify a type of weave to be used to produce the textile identified by the color. More particularly, the textile aggregation facility will "map" the index number and palette for a color to a type of weave to be used by the loom in weaving the textile.

As should be appreciated from the foregoing, and as discussed in more detail below, when a textile aggregation process reviews a draft file or other information for a textile to be produced, the information may indicate multiple different colors for a pattern of the textile, where each color is selected from a palette. Those colors correspond to the hex codes and/or index numbers of the colors shown in the example of FIG. 6A. The textile aggregation process may use the hex code, index number, and/or palette to identify a type of weave (which may also referred be to by a weave number) to be used to weave a particular part of a pattern of a textile.

Figure 6E:
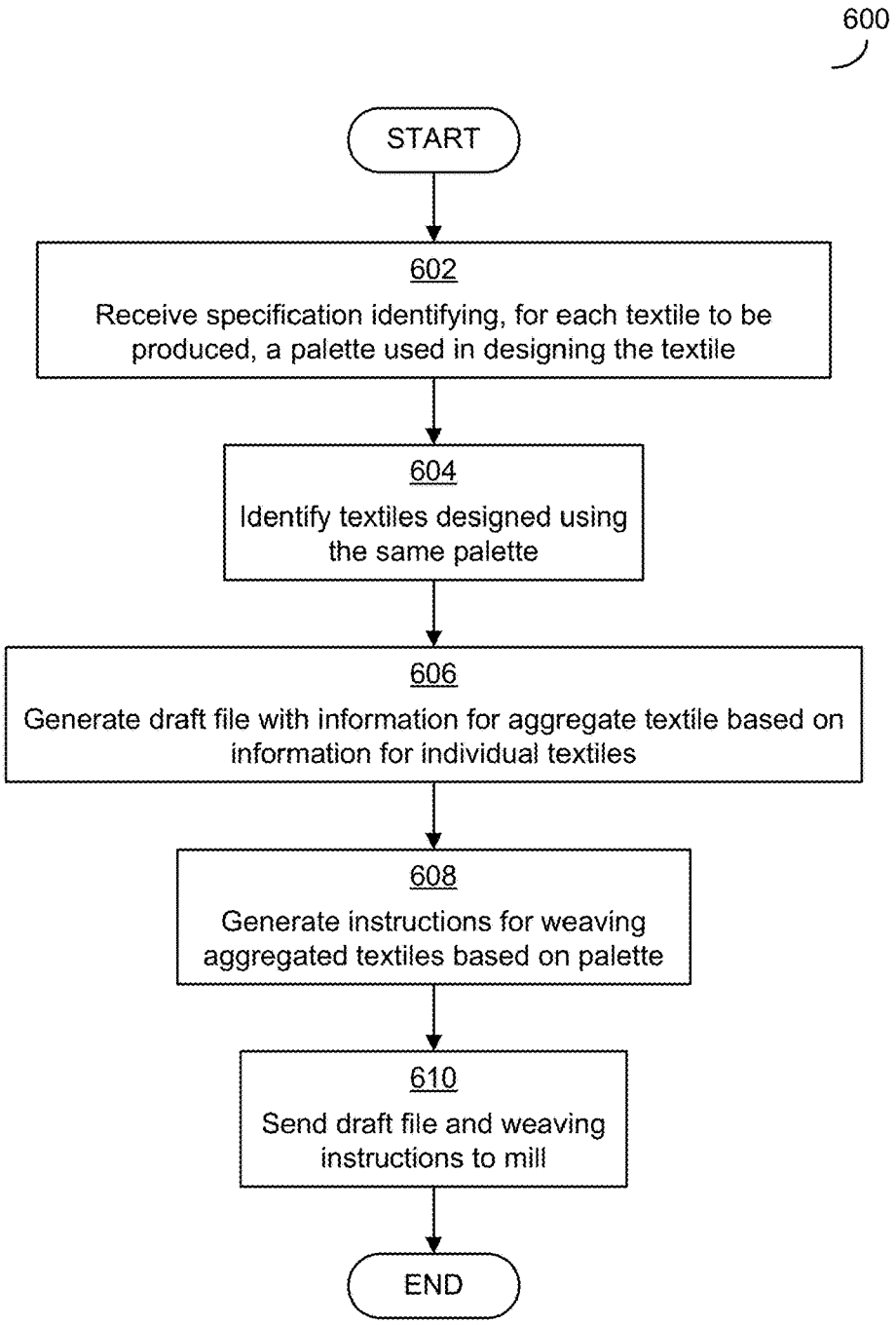
FIG. 6E is a flowchart of an exemplary process that a textile aggregation facility may implement to aggregate textiles for production based on color palettes.

FIG. 6E illustrates an example of a process that may be used by a textile aggregation facility to aggregate textiles based on color palette. The process 600 begins in block 602, in which the textile aggregation facility receives a specification for each of multiple different textiles. The specification may be received as digital information, such as in the form of a draft file or other data structure. The draft file may define a textile, such as by defining a pattern to be woven for the textile. The draft file may include a number of different pixels that define the pattern to be woven, which may be colored according to a color palette. As should be appreciated from the foregoing, the color with which a pixel or a region of pixels of a textile is colored identifies, based on a color palette, a particular set of one, two, or more weft materials to use in weaving that region of the textile and a type of weave for that region. The specification also identifies the color palette used in designing the textile.

In block 604, the textile aggregation facility identifies textiles that were designed using the same color palette. The facility may determine the color palette used in designing the textile by reviewing the specification for the textile received in block 602. Once the facility has identified textiles to be aggregated, the facility in block 606 aggregates the textiles according to techniques described elsewhere herein, to produce a specification for a single aggregated textile. For example, a draft file for an aggregated textile, including information from draft files for multiple different textiles, may be produced. The draft file may, in some embodiments, include pattern information for the aggregate textile that includes the pattern information for each of the aggregate textiles. For example, the draft file may identify regions to be woven using a particular type of weave. The draft file may identify the regions to be woven using a particular type of weave indirectly, by using an identifier for a color within a color palette that a designer has associated with the region. As discussed above, each color is associated with a particular arrangement of weft materials in the weave, specifically, which of the weft materials are brought to the face of the textile during weaving, which may be only some of the weft materials selected by the box motion of the palette. The draft file may include for each region an identifier for a color of the color palette that the designer associated with the region.

In addition, in block 608, the textile aggregation facility generates instructions to a loom for weaving the aggregated textile, which may be based on the color palette used by designers in producing the textiles that have been aggregated. In particular, the instructions may relate to a manner in which the loom should interpret the draft file. For example, the instructions may identify a resolution of the draft file, such as by indicating how many threads are associated with each pixel of the draft file. The instructions may further identify a correspondence between identifiers for colors in the draft file and types of weaves. As should be appreciated from the foregoing, each "color" in the color palette may be associated with a particular type of weave that the loom may be operated to weave. The instructions may identify how the loom is to interpret the colors by identifying, for each color identifier used in the draft file, an identifier for a corresponding type of weave. The identifiers for the types of weave may be identifiers with which the loom is separately configured, including identifiers that are hard-coded into the loom. As discussed above, the type of weave may have been selected based on the weft materials that are to come to the face of the textile and the box motion of the palette. In block 608, the textile aggregation facility "maps" a color/index number and palette identified by a draft file into instructions identifying a type of weave to be used to generate the textile identified by that color/palette.

Once the textile aggregation facility generates the instructions in block 606, 608, the facility sends the draft file and the instructions to the mill in block 610. The facility may send the draft file and instructions in any suitable manner, including by sending the draft file and instructions to the mill over the Internet, from a computing device executing the facility that is located remote from the mill and outside of the operation or control of an operator of the mill. Once the draft file and instructions are sent to the mill, the process 600 ends.

Figure 6F:
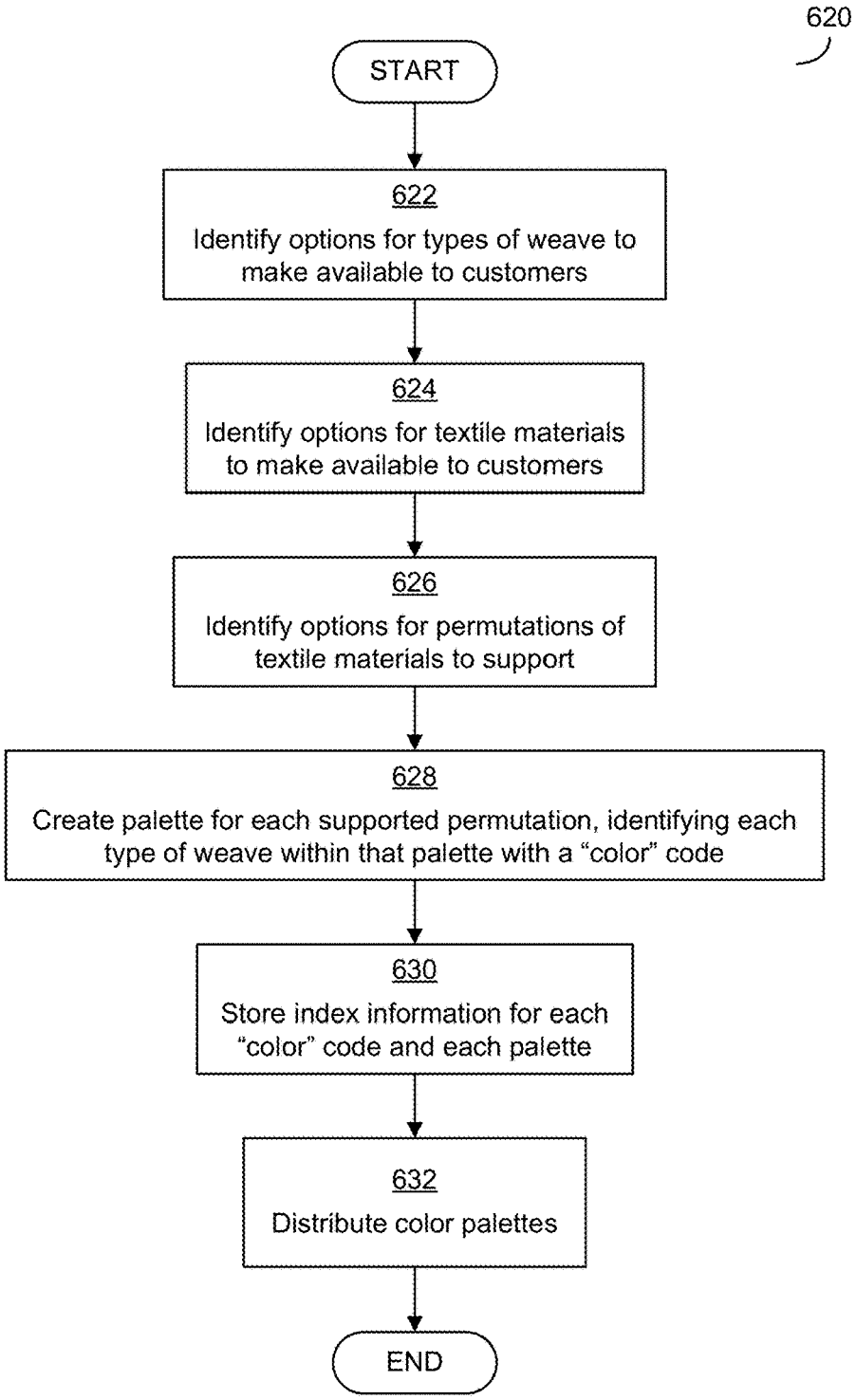
FIG. 6F is a flowchart of an exemplary process that a textile aggregation facility may implement to produce color palettes that may be used in designing textiles.

Examples of color palettes were described above, including examples of palettes that may be distributed to designers for ease of designing textiles that are compatible with some embodiments of a textile aggregation facility. FIG. 6F illustrates an example of a process that may be implemented in some embodiments to produce color palettes that may be supported by a textile aggregation facility.

The process 620 of FIG. 6F begins in block 622, in which an administrator of a textile aggregation facility identifies to the facility options for types of weaves that may be made available to customers. As should be appreciated from the foregoing, a type of weave may be associated with a particular weave pattern and identify that one or more weft materials are brought to the face of a resulting textile. The box motion may not be specifically associated with any textile materials, but instead identifies that whichever textile material is selected first in a box motion, or selected second in the box motion, etc., is to be woven in a particular manner. In addition to type of weave, in some embodiments the administrator may additionally specify a width of the pattern, a thread count, or other attributes. The administrator may also identify which combinations of these options may be made available to customers, such as whether there will be multiple options for types of weaves and only one option for width, thread count, etc. for all types of weaves, or whether there may be multiple options for widths, or other combinations. The administrator may identify the options in any suitable manner, including by inputting the options by a user interface of the textile aggregation facility.

In block 624, the administrator additionally identifies options for textile materials to make available to consumers.

The options for textile materials may include options for warp materials and options for weft materials, including options for different colors, different fibers, or other quality attributes of textile materials described above.

In block 626, the administrator additionally identifies permutations of textile materials to support. The permutations of textile materials may be permutations of weft materials to be loaded onto a loom, and/or permutations of box motions to be used to load a number of weft materials from a creel for weaving. As discussed above, a loom may support only certain warp materials and certain weft materials at a time, such as a number of weft materials up to a number of bobbins on the loom (e.g., eight). Thus, while the administrator may specify many different options for weft materials that may be supported, the administrator may also specify different groups of weft materials (e.g., different groups of eight weft materials) that may be supported, or that may be selected together or in a certain order from the weft materials loaded in a creel. The groups may also include the weft materials at different bobbin locations on the loom, such that two groups may have identical weft materials but arranged at different locations on a loom, or include identical weft materials that are selected in different positions in a box motion. The administrator may additionally specify different warp materials that may be supported, including as options for specific permutations of weft materials or for all permutations of weft materials. The administrator may specify the permutations in any suitable manner, and in any suitable number, as embodiments are not limited in this respect. In some embodiments, an administrator may specify that all permutations may be supported, though because of potential management difficulties from managing a large number of permutations, in other embodiments an administrator may specify only certain permutations.

In block 628, based on the input received in blocks 622-626, the textile aggregation facility creates a palette for each permutation of textile materials to be supported. Each palette may include a "color" to be supported, which may be produced using one of the types of weaves identified in block 622. The color may be identified in any suitable manner, including by identifying a color that may result from weaving textile materials associated with the "color" in a type of weave, which is associated with the "color." Each color of the palette may also be associated with another identifier (e.g., a numeric identifier) identifying its placement in the palette, such as an index value. The type of weave for each color may not be explicitly identified within the palette or within the information for each color of the palette. Rather, the palette may include a palette identifier and, for each color, identifying information for the color such as an index number and/or hex code. The textile aggregation facility, as described above, may use a combination of palette identifier and color identifier (e.g., index number or hex code) to map the color of the palette to a particular type of weave to be used to generate the textile identified by that color of the palette.

In addition to creating the palettes, in block 630 the textile aggregation facility stores index information for each palette indicating the correspondence between the identifier for each color in the palette and a type of weave associated with that identifier/color, and textile materials associated with the palette.

In block 632, once the palettes are created, the textile aggregation facility may also distribute the palettes to designers for use with computer-aided textile design software, such as EAT, or general-purpose image design software, such as software available from Adobe Systems Incorporated. The palettes may be distributed using known techniques for associating color palettes with such software, such as by offering the color palettes as a form of plug-in for the software. The facility may distribute the palettes by making the palettes available for download by designers. Once the palettes are distributed, the process 620 ends.

In the examples described above, the textile aggregation facility determines the corresponding set of attributes for a textile, such as a corresponding palette. Those skilled in the art may appreciate, however, that there may be cases in which a set of attributes for a textile does not precisely match any of the predefined sets of attributes with which a textile aggregation facility has been configured. In some embodiments, a textile aggregation facility may be configured to identify textiles that do not match any of the existing sets of attributes. In response to such a determination, the textile aggregation facility may identify one or more changes that can be made to attributes for a textile to enable the textile aggregation facility to match the textile to a predefined set, or multiple alternative sets of such one or more changes. For example, the facility may identify that a change to a pick density could be made, or a change to one or more colors or compositions of weft materials to be used. The textile aggregation facility may identify the changes that could be made in any suitable manner, as embodiments are not limited in this respect. For example, the facility may be configured with a set of attributes for which alternatives could be suggested and configured with an order in which to suggest changes to those attributes for a textile. For example, the facility may be configured to suggest a change to a weft color if the weft colors for a textile do not match colors for any of the predefined sets, and a change to a pick density if the colors do match, and so on. To identify a particular change to be suggested, the facility may identify a closest match for an attribute that would enable the textile to be matched with one or more of the predefined sets of attributes. For example, with respect to weft color, the facility may evaluate a hexadecimal code for a weft color of the textile and identify a nearest hexadecimal code for a color that would match one of the predefined sets. In some cases, such a "nearest" match may, in some cases, be restricted to be within a threshold numeric amount of the textile's original hexadecimal value, to ensure that a proposed color is relatively close to the original color.

When a textile aggregation facility aggregates textiles for production, the facility may place the facility into any suitable order for production, as embodiments are not limited in this respect. In some embodiments, the order of the textiles during production may correspond to an order in which the textiles were received by the facility from customers.

Figure 7:
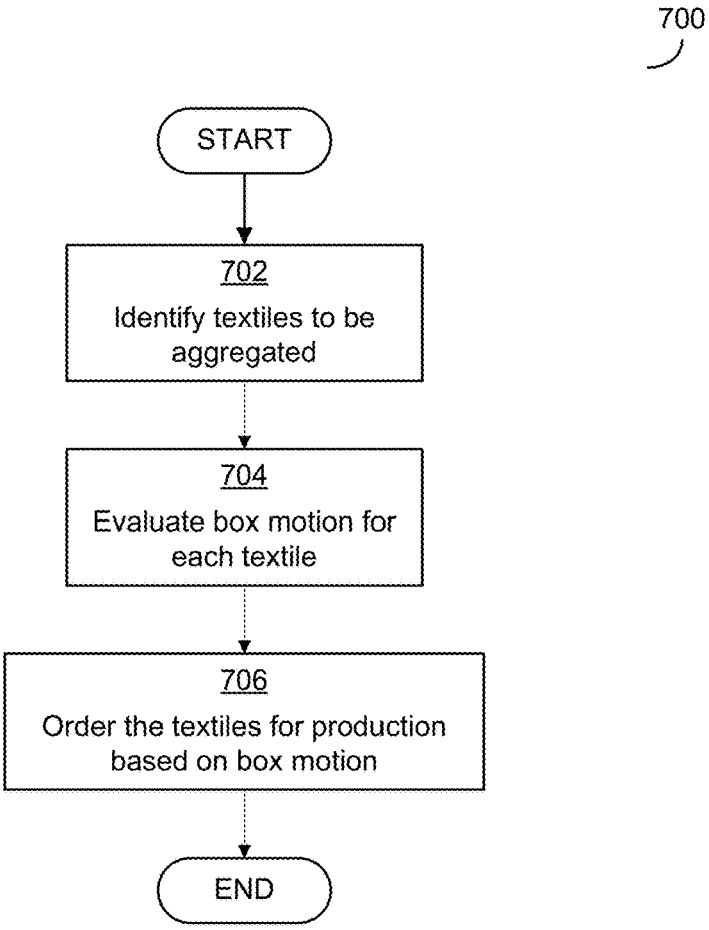
FIG. 7 is a flowchart of an exemplary process that a textile aggregation facility may implement to order aggregated textiles for production in some embodiments.

FIG. 7 illustrates an example of a process 700 that may be implemented by a textile aggregation facility in some embodiments to order aggregated textiles based on a box motion that a loom will use to produce each of the textiles. As should be appreciated from the foregoing, the box motion of a loom is an order in which weft materials are selected from rods for insertion into the shed during weaving. A loom may use any box motion at any time during weaving.

The process 700 begins in block 702, in which the facility identifies textiles that are to be aggregated for production. The facility may identify the textiles in any suitable manner, including according to examples of evaluation techniques described above. Once the textiles that are to be aggregated have been identified, in block 704 the facility evaluates a box motion that will be used to produce each of the textiles.

The textile aggregation facility may identify the box motion in any suitable manner. For example, in embodiments that use palettes as described above in connection with FIGS. 6A-6F, the facility may use the palette used to design a textile to identify a box motion, as the palette may be associated with a particular permutation of weft materials in a creel, which will affect the box motion used to select the weft materials. In some embodiments, the facility may identify the box motion based on information that the facility has stored that indicates an ordering of weft materials on a loom as well as information for each textile that indicates colors to be included in the textiles. The facility may determine the box motion(s) that will be used during the production of each textile by identifying which weft materials will need to be inserted in which order to yield the colors to be included in the textiles to be produced.

In block 706, the facility may order the textiles for production based on the box motions that will be used to produce each textile. The ordering may be carried out in any suitable manner, as embodiments are not limited in this respect. For example, the facility may place textiles that will use the same box motion adjacent in the ordering. As another example, the facility may order textiles such that textiles that have the same beginning of a box motion are placed adjacent to one another in the ordering. As a specific example of such ordering based on beginning of the order, a textile that will use the box motion "1, 3, 5, 6" (referring to a successive insertion of the weft material on bobbin 1, then bobbin 3, then bobbins 5 and 6) may be placed near or adjacent in the ordering to a textile that will use the box motion "1, 3, 5, 8" because the two box motions share the beginning sequence "1, 3, 5."

Once the textiles are ordered in block 706, the process 700 ends.

While FIG. 7 illustrated an example of a process in which box motion was used to determine an order in which to produce multiple textiles during a single operation of a loom, it should be appreciated that other embodiments may additionally or alternatively use other attributes of textiles to determine an ordering of textiles. For example, a pick/weft density of textiles may be used to order textiles for production. In some looms, pick density may only be adjusted during a configuration phase of a single operation of a mill, and on such looms all textiles that are produced during a single operation of the loom must have the same pick density. In other looms, though, a pick density may be adjusted during a single operation of the loom. In some embodiments that operate with such looms, textiles may be ordered for production based on pick density. For example, textiles may be ordered such that textiles having a same pick density are placed adjacent to one another in the ordering, and/or such that textiles are sorted based on increasing/decreasing pick densities, or sorted based on pick densities in some other manner.

In some embodiments, a single piece of mill-finished fabric that is produced from an aggregation of textiles for production may simply include a sequence of fabrics, one after immediately after the other in the sequence. In other embodiments, the textile aggregation facility may aggregate textiles for production along with an instruction to insert a spacing between textiles in the fabric. The spacing may be produced in any suitable manner, including as a strip of any suitable width (e.g., one inch) of a single color of weft inserted into the warp. The textile aggregation facility may create the spacing in any suitable manner, including by aggregating textiles received from customers along with information on a textile that is defined as such a thin, single-color strip.

Figure 8:
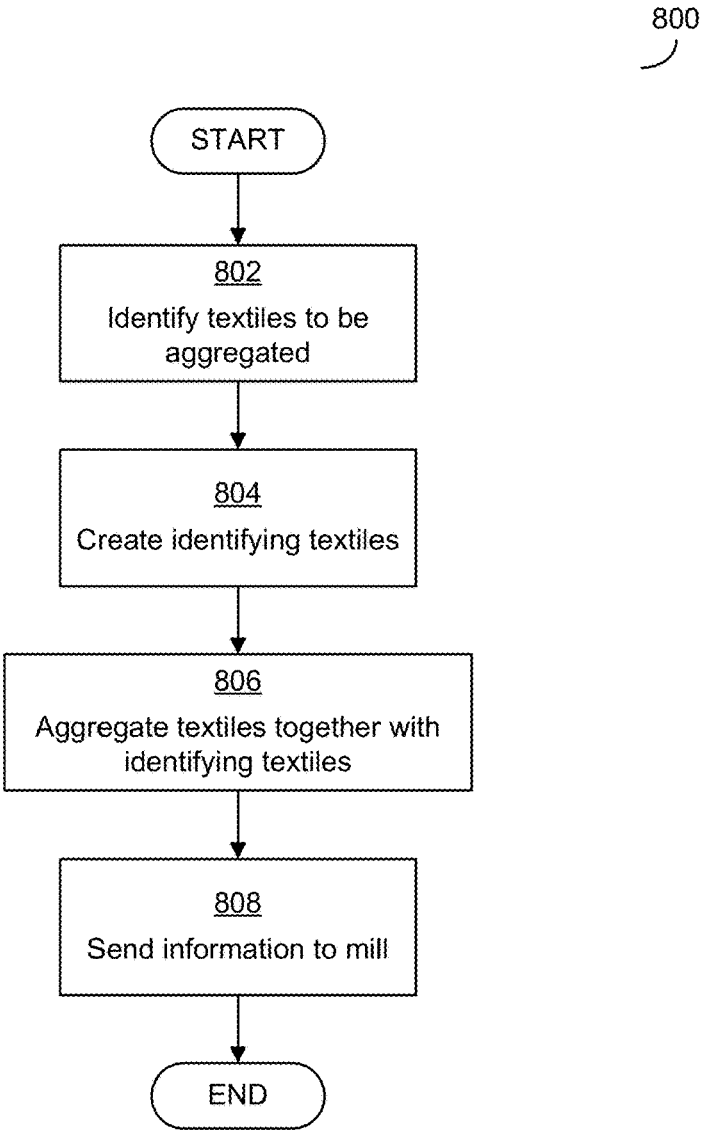
FIG. 8 is a flowchart of an exemplary process that a textile aggregation facility may implement to aggregate textiles together with identifying information for the textiles in some embodiments.

FIG. 8 illustrates an example of a process 800 that a textile aggregation facility may use to aggregate textiles for production along with identifying information for each textile included in the loom-finished fabric between aggregated textiles. The process 800 begins in block 802, in which the facility identifies textiles that are to be aggregated for production. The facility may identify the textiles in any suitable manner, including according to examples of evaluation techniques described above.

Once the textiles that are to be aggregated have been identified, in block 804 the textile aggregation facility creates an identifying textile for each of the textiles that have been received from customers. The identifying textile may be defined in the same manner as the textiles that have been received from customers, such as being defined using digital information that identifies weft and warp materials to be included in the identifying textile and a pattern a loom will follow to produce the identifying textile. The pattern to be followed for the identifying textile may be a pattern that would result in the loom producing woven text in the fabric from the pattern of interlaced warp and weft materials. For each identifying textile, the woven text may include any suitable identifying information for a corresponding textile received from a customer, such as the customer's name and order number.

In block 806, after producing the identifying textiles for each textile received from a customer, the textile aggregation facility aggregates each of the textiles received from customers along with the identifying textiles, such that each identifying textile is placed adjacent to the customer textiles to which it corresponds. The textile aggregation facility may then produce information on the aggregated set of textiles, such as a single file that identifies each of the textiles or a weave program for execution by a loom controller to produce each of the textiles. In block 808, the facility sends the produced information to the mill in any suitable manner, including using any of the examples described above. Once the information is sent, the process 800 ends.

As should be appreciated from the foregoing, due to mills requiring minimum amounts of fabrics, it may be the case that many of the textiles ordered via a textile aggregator may not be able to be produced by themselves because the amount of textile to be produced may be lower than the minimum. By aggregating textiles, the minimum amount of textile to be produced may be met or exceeded. This produces a possibility, though, that due to the textiles that are received from customers at a given time, one textile may not be able to be aggregated with other textiles, because it may not have attributes that match other textiles. Additionally, even where a textile may be aggregated with others, it is possible that an amount of aggregated textile may not meet or exceed a minimum amount of textile. In some embodiments, once an order is received the order may be held until it can be produced on a mill. In other embodiments, however, following a period of time a customer may be prompted for whether to continue with the order.

Figure 9:
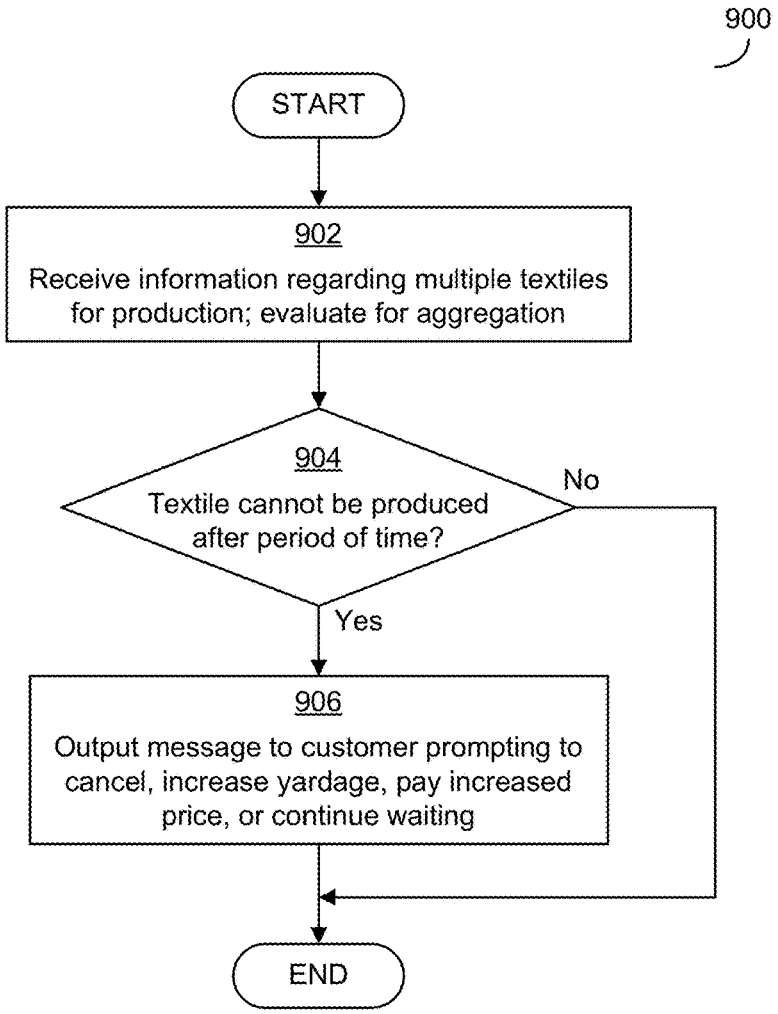
FIG. 9 is a flowchart of an exemplary process that a textile aggregation facility may implement in some embodiments to interact with a customer regarding a textile that has not been produced following a threshold period of time.

FIG. 9 illustrates an example of a process 900 that a textile aggregation facility may implement to communicate with customers regarding pending orders. The process 900 begins in block 902, in which the facility receives information regarding multiple textiles for production and evaluates the textiles for aggregation using any of the exemplary techniques described above.

In block 904, the textile aggregation facility determines whether a threshold period of time has elapsed since a textile was received and the textile still has not been produced. Any suitable period of time may be used, as embodiments are not limited in this respect. As discussed above, the textile may not be producible because the textile cannot be aggregated with any other textiles that have been received or because, though the textile has been aggregated with others, the amount of aggregated textile to be produced does not meet or exceed a minimum amount for a mill.

If the threshold period of time has not elapsed or there is no textile that has not yet been produced, the process 900 ends. If, however, the facility determines that the threshold period of time has elapsed for a textile, then the textile aggregation facility outputs a message to the customer that ordered the textile. The message may be output in any suitable manner, as embodiments are not limited in this respect. In some embodiments, the message may be output as an email message. The message may include any suitable content. The message may describe to the customer that the textile has not yet been produced and present several options to the customer for how to proceed, including canceling the order, or increasing an amount of yardage to produce, or paying an increased price to produce the same amount of yardage (which price may be passed on to the mill as an incentive to produce less than the minimum amount of fabric), or continuing to wait. Once the message has been output, the process 900 ends. Following the process 900, the facility may receive from the customer a selection of one of the options presented and may act in accordance with the selected option.

In some embodiments, a textile aggregation facility may continuously or occasionally evaluate a set of textiles that have been previously received and are awaiting aggregation and production, and act to try to persuade other customers to place orders that could be aggregated with the prior orders and that would permit the prior orders to be produced. For example, the facility may adjust a pricing of textiles that have particular attributes as an incentive for other customers to place orders for textiles having those attributes. By incentivizing textiles having particular attributes, the facility may encourage customers to place orders for textiles that have those attributes and thus may receive orders that may be aggregated with existing orders and enable textiles for existing orders to be produced.

Figure 10:
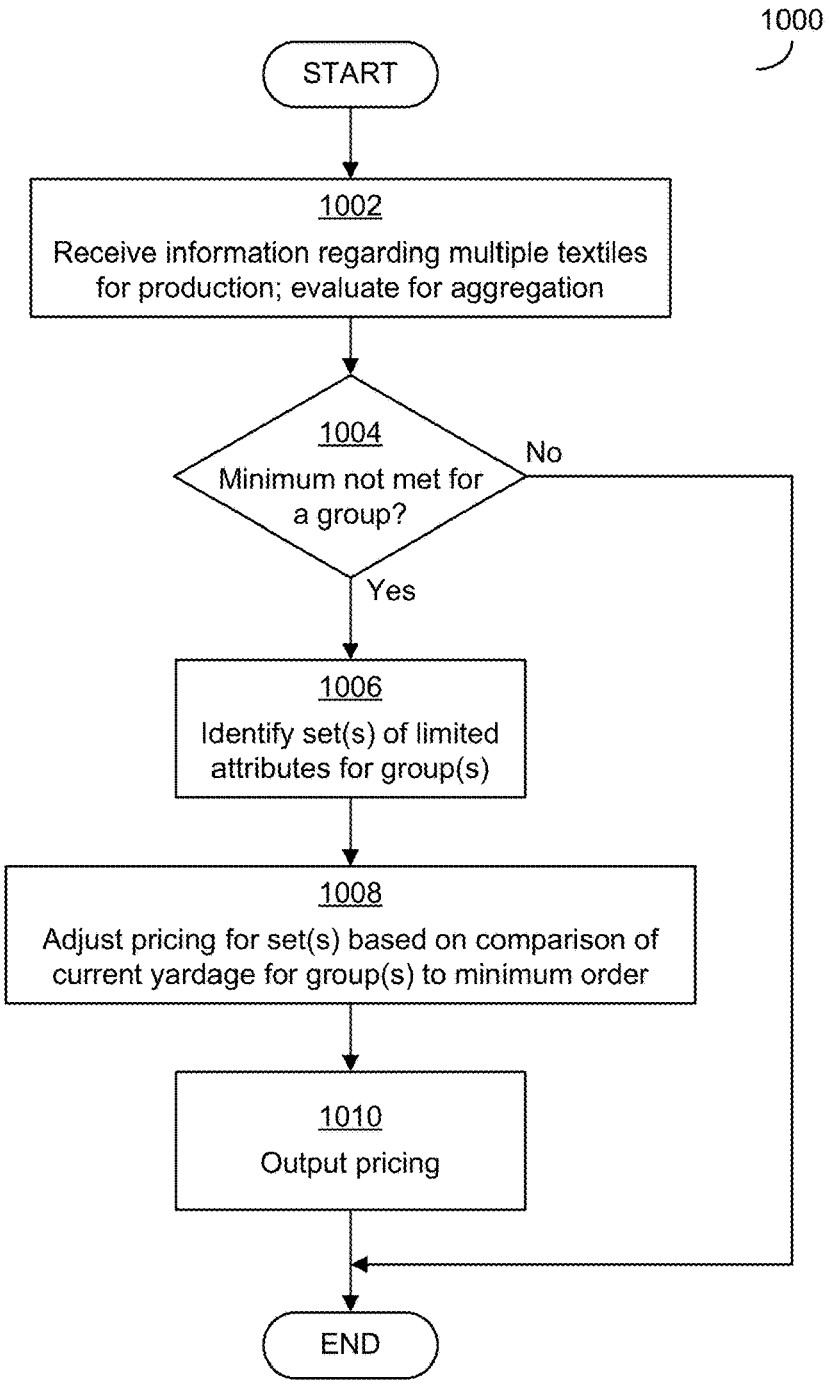
FIG. 10 is a flowchart of an exemplary process that a textile aggregation facility may implement in some embodiments to adjust pricing of textiles.

An example of such a process is illustrated in FIG. 10. The process 1000 of FIG. 10 begins in block 1002, in which the facility receives information regarding multiple textiles for production and evaluates the textiles for aggregation using any of the exemplary techniques described above.

Based on the evaluation of block 1002, one or more groups of textiles may be identified. Each group may be associated with a total amount of aggregated textile to be produced. In block 1004, the facility determines for each group whether the total amount does not meet or exceed the minimum amount that must be ordered for the mill to produce the aggregated textiles. If not, and all groups meet or exceed the minimum order, the process 1000 ends. If, however, the minimum amount is not met or exceeded by any group, then in block 1006 the facility may identify for each group a set of attributes that relate to the group of aggregated textiles. The identification is performed in block 1006 to identify the attributes to be incentivized, to encourage customers to place orders that would meet those attributes and could be aggregated with the existing orders to exceed the minimum amount and allow the aggregated textiles to be produced. The facility may identify the set of attributes in block 1006 based on attributes of the textiles that have already been aggregated into one of the groups. In cases in which sets of limited attributes are predefined (e.g., as discussed in connection with FIG. 5), the attributes identified in block 1006 are the predefined attributes for the group.

In block 1008, once the attributes have been determined, the facility adjusts a pricing associated with the set of attributes. The pricing may be adjusted based on a comparison of a current total amount of textile to be produced for each group and the minimum amount of textile to be produced. For example, if the comparison indicates that the total amount is very close to the minimum amount, then in some embodiments a lower price may be set as the incentivized price than if the total amount is farther away from the minimum amount. Such a lower price may be used because, based on how close the total amount is to the minimum, only one or a small number of additional orders may be needed to meet the minimum. As another example, however, if the comparison indicates that the total amount is very far from the minimum amount, a lower price may be used than if the total amount is closer, because a large number of orders may be needed and a large number of customers may need to be incentivized. In some embodiments that implement such a process, the facility may be configured with thresholds that are each associated with particular prices or price discounts, and prices may be set in block 1008 based on comparisons with thresholds.

Once the prices are set in block 1008, the textile aggregation facility may output the prices in block 1010 to be viewed by users. The prices may be output in any suitable manner, as embodiments are not limited in this respect. In some embodiments, the prices may be output via a web interface and/or via an email message. Once the prices are output, the process 1000 ends.

Techniques operating according to the principles described herein may be implemented in any suitable manner. Included in the discussion above are a series of flow charts showing the steps and acts of various processes that aggregate textiles for production during a single operation of a loom. The processing and decision blocks of the flow charts above represent steps and acts that may be included in algorithms that carry out these various processes. Algorithms derived from these processes may be implemented as software integrated with and directing the operation of one or more single- or multi-purpose processors, may be implemented as functionally-equivalent circuits such as a Digital Signal Processing (DSP) circuit or an Application-Specific Integrated Circuit (ASIC), or may be implemented in any other suitable manner. It should be appreciated that the flow charts included herein do not depict the syntax or operation of any particular circuit or of any particular programming language or type of programming language. Rather, the flow charts illustrate the functional information one skilled in the art may use to fabricate circuits or to implement computer software algorithms to perform the processing of a particular apparatus carrying out the types of techniques described herein. It should also be appreciated that, unless otherwise indicated herein, the particular sequence of steps and/or acts described in each flow chart is merely illustrative of the algorithms that may be implemented and can be varied in implementations and embodiments of the principles described herein.

Accordingly, in some embodiments, the techniques described herein may be embodied in computer-executable instructions implemented as software, including as application software, system software, firmware, middleware, embedded code, or any other suitable type of computer code. Such computer-executable instructions may be written using any of a number of suitable programming languages and/or programming or scripting tools, and also may be compiled as executable machine language code or intermediate code that is executed on a framework or virtual machine.

When techniques described herein are embodied as computer-executable instructions, these computer-executable instructions may be implemented in any suitable manner, including as a number of functional facilities, each providing one or more operations to complete execution of algorithms operating according to these techniques. A "functional facility," however instantiated, is a structural component of a computer system that, when integrated with and executed by one or more computers, causes the one or more computers to perform a specific operational role. A functional facility may be a portion of or an entire software element. For example, a functional facility may be implemented as a function of a process, or as a discrete process, or as any other suitable unit of processing. If techniques described herein are implemented as multiple functional facilities, each functional facility may be implemented in its own way; all need not be implemented the same way. Additionally, these functional facilities may be executed in parallel and/or serially, as appropriate, and may pass information between one another using a shared memory on the computer(s) on which they are executing, using a message passing protocol, or in any other suitable way.

Generally, functional facilities include routines, programs, objects, components, data structures, etc. that perform particular tasks or implement particular abstract data types. Typically, the functionality of the functional facilities may be combined or distributed as desired in the systems in which they operate. In some implementations, one or more functional facilities carrying out techniques herein may together form a complete software package. These functional facilities may, in alternative embodiments, be adapted to interact with other, unrelated functional facilities and/or processes, to implement a software program application.

Some exemplary functional facilities have been described herein for carrying out one or more tasks. It should be appreciated, though, that the functional facilities and division of tasks described is merely illustrative of the type of functional facilities that may implement the exemplary techniques described herein, and that embodiments are not limited to being implemented in any specific number, division, or type of functional facilities. In some implementations, all functionality may be implemented in a single functional facility. It should also be appreciated that, in some implementations, some of the functional facilities described herein may be implemented together with or separately from others (i.e., as a single unit or separate units), or some of these functional facilities may not be implemented.

Computer-executable instructions implementing the techniques described herein (when implemented as one or more functional facilities or in any other manner) may, in some embodiments, be encoded on one or more computer-readable media to provide functionality to the media. Computer-readable media include magnetic media such as a hard disk drive, optical media such as a Compact Disk (CD) or a Digital Versatile Disk (DVD), a persistent or non-persistent solid-state memory (e.g., Flash memory, Magnetic RAM, etc.), or any other suitable storage media. Such a computer-readable medium may be implemented in any suitable manner, including as computer-readable storage media 1106 of FIG. 11 described below (i.e., as a portion of a computing device 1100) or as a stand-alone, separate storage medium. As used herein, "computer-readable media" (also called "computer-readable storage media") refers to tangible storage media. Tangible storage media are non-transitory and have at least one physical, structural component. In a "computer-readable medium," as used herein, at least one physical, structural component has at least one physical property that may be altered in some way during a process of creating the medium with embedded information, a process of recording information thereon, or any other process of encoding the medium with information. For example, a magnetization state of a portion of a physical structure of a computer-readable medium may be altered during a recording process.

Figure 11:
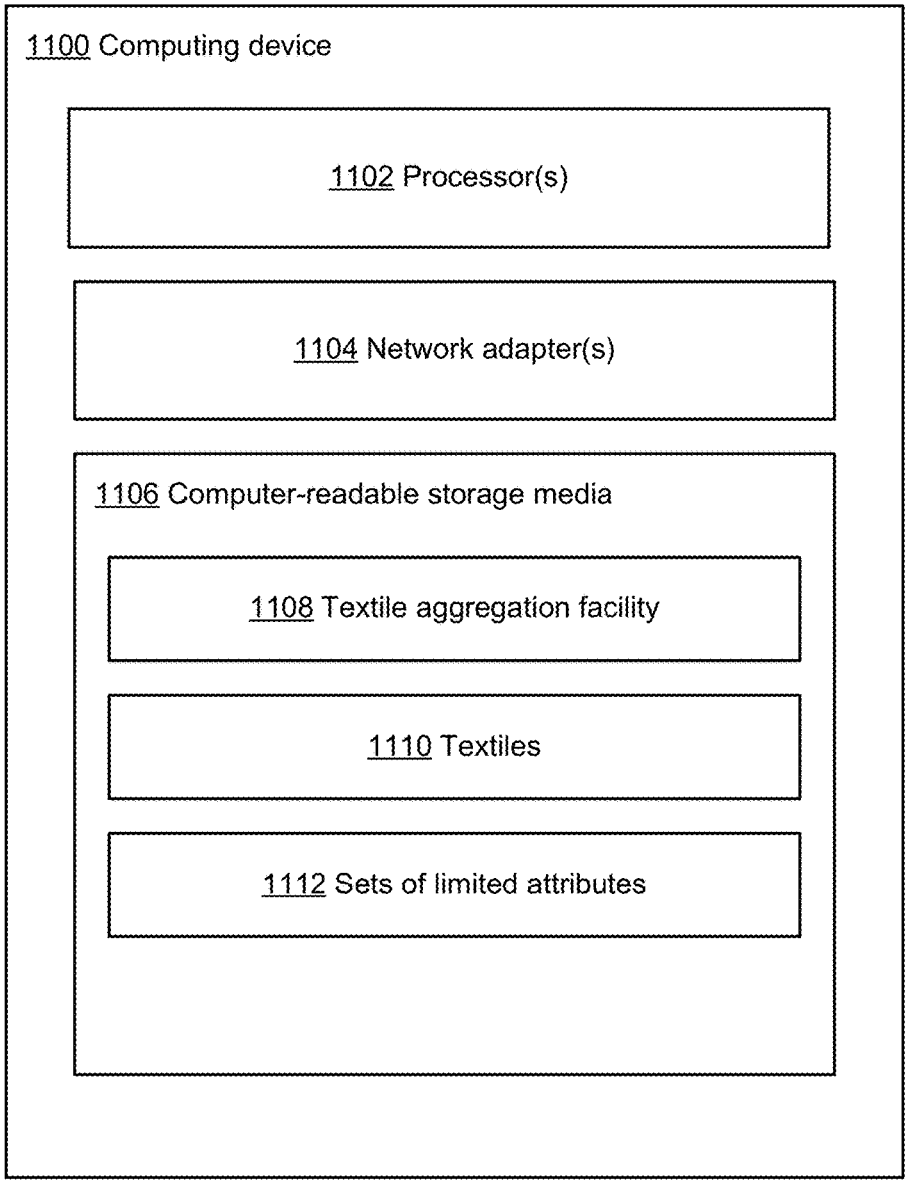
FIG. 11 is a block diagram of a computing device with which some embodiments may operate.

In some, but not all, implementations in which the techniques may be embodied as computer-executable instructions, these instructions may be executed on one or more suitable computing device(s) operating in any suitable computer system, including the exemplary computer system of FIG. 11, or one or more computing devices (or one or more processors of one or more computing devices) may be programmed to execute the computer-executable instructions. A computing device or processor may be programmed to execute instructions when the instructions are stored in a manner accessible to the computing device or processor, such as in a data store (e.g., an on-chip cache or instruction register, a computer-readable storage medium accessible via a bus, a computer-readable storage medium accessible via one or more networks and accessible by the device/processor, etc.). Functional facilities comprising these computer-executable instructions may be integrated with and direct the operation of a single multi-purpose programmable digital computing device, a coordinated system of two or more multi-purpose computing device sharing processing power and jointly carrying out the techniques described herein, a single computing device or coordinated system of computing device (co-located or geographically distributed) dedicated to executing the techniques described herein, one or more Field-Programmable Gate Arrays (FPGAs) for carrying out the techniques described herein, or any other suitable system.

FIG. 11 illustrates one exemplary implementation of a computing device in the form of a computing device 1100 that may be used in a system implementing techniques described herein, although others are possible. It should be appreciated that FIG. 11 is intended neither to be a depiction of necessary components for a computing device to operate in accordance with the principles described herein, nor a comprehensive depiction.

Computing device 1100 may comprise at least one processor 1102, a network adapter 1104, and computer-readable storage media 1106. Computing device 1100 may be, for example, a desktop or laptop personal computer, a server, or any other suitable computing device. Network adapter 1104 may be any suitable hardware and/or software to enable the computing device 1100 to communicate wired and/or wirelessly with any other suitable computing device over any suitable computing network. The computing network may include wireless access points, switches, routers, gateways, and/or other networking equipment as well as any suitable wired and/or wireless communication medium or media for exchanging data between two or more computers, including the Internet. Computer-readable media 1106 may be adapted to store data to be processed and/or instructions to be executed by processor 1102. Processor 1102 enables processing of data and execution of instructions. The data and instructions may be stored on the computer-readable storage media 1106 and may, for example, enable communication between components of the computing device 1100.

The data and instructions stored on computer-readable storage media 1106 may comprise computer-executable instructions implementing techniques which operate according to the principles described herein. In the example of FIG. 11, computer-readable storage media 1106 stores computer-executable instructions implementing various facilities and storing various information as described above. Computer-readable storage media 1106 may store instructions for a textile aggregation facility 1108, as well as data 1108 on textiles and data 1110 on sets of limited attributes for textiles with which the textile aggregation facility 1108 has been configured.

While not illustrated in FIG. 11, a computing device may additionally have one or more components and peripherals, including input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computing device may receive input information through speech recognition or in other audible format.

Embodiments have been described where the techniques are implemented in circuitry and/or computer-executable instructions. It should be appreciated that some embodiments may be in the form of a method, of which at least one example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Various aspects of the embodiments described above may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The word "exemplary" is used herein to mean serving as an example, instance, or illustration. Any embodiment, implementation, process, feature, etc. described herein as exemplary should therefore be understood to be an illustrative example and should not be understood to be a preferred or advantageous example unless otherwise indicated.

Having thus described several aspects of at least one embodiment, it is to be appreciated that various alterations, modifications, and improvements will readily occur to those skilled in the art. Such alterations, modifications, and improvements are intended to be part of this disclosure, and are intended to be within the spirit and scope of the principles described herein. Accordingly, the foregoing description and drawings are by way of example only.

What is claimed is:

1. A method of producing an aggregate textile comprising a plurality of different textiles that a plurality of different customers requested be produced, the method comprising:

operating at least one processor to carry out acts of:

receiving information describing each textile of the plurality of different textiles to be produced, the information comprising, for each textile of the plurality of different textiles, one or more quality attributes for the textile;

evaluating quality attributes for each of the plurality of different textiles to identify two or more textiles of the plurality of different textiles having matching quality attributes; and generating a specification for the aggregate textile based on the information describing the two or more textiles, the specification of the aggregate textile including at least some of the quality attributes for the two or more textiles and specifying that the aggregate textile is to be woven by weaving the two or more textiles in a series during a single run of a loom.

2. The method of claim 1, wherein:

the two or more textiles are two or more first textiles;

evaluating the quality attributes further comprises identifying, as a result of the evaluation, two or more second textiles of the plurality of different textiles having matching quality attributes, the two or more second textiles being different from the two or more first textiles; and the method further comprises operating the at least one processor to carry out an act of generating a specification for a second aggregate textile based on the information describing the two or more second textiles, the specification of the second aggregate textile including at least some of the quality attributes for the two or more second textiles and specifying that the second aggregate textile is to be woven by weaving the two or more second textiles in a series.

3. The method of claim 1, wherein evaluating quality attributes for each of the plurality of different textiles to identify two or more textiles of the plurality of different textiles having matching quality attributes comprises evaluating the quality attributes to identify two or more textiles having identical quality attributes.

4. The method of claim 1, wherein evaluating quality attributes for each of the plurality of different textiles to identify two or more textiles of the plurality of different textiles having matching quality attributes comprises evaluating the quality attributes to identify two or more textiles that indicate that the two or more textiles can each be woven together during the single run of a loom.

5. The method of claim 1, wherein:

the quality attributes for each textile including in the information describing each textile of the plurality of textiles comprises information regarding quality of textile materials to be woven to produce the textile; and evaluating the quality attributes comprises evaluating the information regarding the quality of the textile materials.

6. The method of claim 5, wherein the information regarding the quality of the textile materials comprises information regarding one or more yarns to be woven.

7. The method of claim 5, wherein the information regarding the quality of the textile materials comprises information regarding color, composition, and/or weight of one or more textile materials to be woven to produce the textile.

8. The method of claim 5, wherein:

the information regarding the quality of the textile materials comprises information regarding quality of one or more warp materials and quality of one or more weft materials to be woven in producing the textiles; and evaluating the quality attributes comprises identifying, in the plurality of different textiles, two or more textiles to be produced using, as weft materials, textile materials that are identical or that can be loaded together on the loom.

9. The method of claim 8, wherein identifying two or more textiles to be produced using, as weft materials, textile materials that are identical or that can be loaded together on a loom comprises identifying two or more textiles to be produced using, as weft materials, up to a maximum number of different textile materials.

10. The method of claim 1, wherein:

the quality attributes for each textile included in the information describing each textile of the plurality of textiles comprises information regarding quality of at least one weave of the textile, the information regarding the quality of each of the at least one weave comprising information regarding a style of the weave, width of the weave, type of the weave, and/or thread count of the weave; and evaluating the quality attributes comprises evaluating the information regarding the quality of the at least one weave.

11. The method of claim 1, wherein:

the quality attributes for each textile include an indication of a creel set for the textile, the creel set identifying a set of weft materials to be loaded onto the loom during weaving of the textile; and evaluating the quality attributes comprises evaluating the indication of the creel set.

12. The method of claim 1, wherein:

the quality attributes for each textile including in the information describing each textile of the plurality of textiles comprises information regarding a manner in which the loom is to be operated to produce the textile; and evaluating the quality attributes comprises evaluating the information regarding the manner in which the loom is to be operated to produce each textile to identify two or more textiles that can be woven together without risk of damage to the loom.

13. The method of claim 1, wherein receiving the information describing each of the plurality of different textiles comprises receiving a plurality of draft files.

14. The method of claim 1, wherein generating the specification for the aggregate textile comprises generating a weave program that, when executed by a loom controller, causes the loom to produce, during the single run of the loom, the aggregate textile including each of the two or more textiles in series.

15. The method of claim 1, wherein:

the information describing each textile of the plurality of different textiles comprises a yardage of the textile to be produced; and generating the specification comprises generating the specification in response to determining that a total yardage of the two or more textiles exceeds a minimum.

16. The method of claim 1, wherein:

evaluating the quality attributes for each of the plurality of different textiles comprises identifying, for each textile, to which textile set of a plurality of predefined textile sets the textile belongs based at least in part on an evaluation of the quality attributes for the textile; and the two or more textiles each belong to a same textile set.

17. The method of claim 1, wherein generating the specification for the aggregate textile comprises:

determining an order in which the two or more textiles will be produced during production of the aggregate textile, wherein determining the order comprises determining the order based at least in part on a box motion that the loom will use to produce each textile; and generating the specification comprises generating a specification indicating that the aggregate textile is to be woven with the two or more textiles in a series according to the order.

18. The method of claim 1, wherein generating the specification for the aggregate textile comprises:

determining an order in which the two or more textiles will be produced during production of the aggregate textile based at least in part on the one or more quality attributes of each textile; and generating the specification comprises generating a specification indicating that the aggregate textile is to be woven with the two or more textiles in a series according to the order.

19. The method of claim 1, wherein generating the specification for the aggregate textile comprises:

generating a specification specifying that the aggregate textile is to be woven by weaving the two or more textiles in a series with woven identifying information for each successive textile between the textiles in the aggregate textiles.

20. At least one non-transitory computer-readable storage medium having encoded thereon executable instructions that, when executed by at least one processor, cause the at least one processor to carry out a method of producing an aggregate textile comprising a plurality of different textiles that a plurality of different customers requested be produced, the method comprising:

receiving information describing each textile of the plurality of different textiles to be produced, the information comprising, for each textile of the plurality of different textiles, one or more quality attributes for the textile;

evaluating quality attributes for each of the plurality of different textiles to identify two or more textiles of the plurality of different textiles having matching quality attributes; and generating a specification for the aggregate textile based on the information describing the two or more textiles, the specification of the aggregate textile including at least some of the quality attributes for the two or more textiles and specifying that the aggregate textile is to be woven by weaving the two or more textiles in a series.

21. A method of aggregating textiles to be woven in aggregate during a single operation of a loom, wherein a palette of a plurality of palettes of colors is used in designing each of the textiles, wherein each palette is associated with one of a plurality of different permutations of different textile materials, wherein each color of a palette corresponds to a type of weave in which at least some of the textile materials of the permutation with which the palette is associated are to be woven to produce the textile, and wherein each palette includes colors corresponding to at least some of a plurality of different types of weaves, the method comprising:

receiving, from a plurality of different customers, specifications for a plurality of different textiles, each specification indicating for a corresponding textile of the plurality of textiles a pattern of the textile to be woven, wherein each specification indicates which palette of the plurality of palettes was used in designing the textile and identifies different regions of the pattern of the textile by indicating a different color from the palette;

aggregating specifications for some of the plurality of textiles to produce a specification of a single aggregated textile, wherein aggregating the specifications comprises aggregating specifications for textiles of the plurality of different textiles for which the specifications indicate the same palette was used in designing the textile; and triggering operation of a loom to produce, during a single run of the mill, the single aggregated textile including the plurality of textiles.

22. The method of claim 21, further comprising:

producing weaving instructions for the single aggregated textile to instruct the loom on which type of weave to use for each region of the single aggregated textile, wherein triggering operation of the loom comprises transmitting, from at least one first computing device performing the method to at least one second computing device associated with a mill.

23. The method of claim 22, wherein the at least one first computing device is located remote from the at least one second computing device and is not under the operation or control of an operator of the mill.

24. The method of claim 21, wherein:

the plurality of palettes are collectively associated with a plurality of different textile materials; and each palette of the plurality of palettes is associated with a permutation of a subset of the plurality of different textile materials.

25. The method of claim 24, wherein each palette of the plurality of palettes is associated with a subset of the plurality of different textile materials each loaded at a specified position on a bobbin of a mill.

26. The method of claim 21, wherein:

aggregating specifications for some of the plurality of textiles to produce the specification of the single aggregated textile further comprises aggregating specifications for textiles of the plurality of different textiles for which the specifications indicate complementary palettes were used in designing the textiles; and complementary palettes are palettes that are associated with different permutations of textile materials from a same set of textile materials, each of the different permutations of textile materials being at least a subset of textile materials from the same set of textile materials, the same set of textile materials being a set of textile materials to be loaded together into a creel of the loom.

* * * * *